US010731916B2

(12) United States Patent
Yeom

(10) Patent No.: US 10,731,916 B2
(45) Date of Patent: Aug. 4, 2020

(54) REFRIGERATOR

(71) Applicant: LG Electronics Inc., Seoul (KR)

(72) Inventor: Taejin Yeom, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/230,509

(22) Filed: Dec. 21, 2018

(65) Prior Publication Data

US 2019/0293341 A1 Sep. 26, 2019

(30) Foreign Application Priority Data

Mar. 26, 2018 (KR) ..... 10-2018-0034745
Apr. 2, 2018 (KR) ..... 10-2018-0038327
Apr. 2, 2018 (KR) ..... 10-2018-0038344

(51) Int. Cl.

| | |
|---|---|
| ***F25D 25/02*** | (2006.01) |
| ***F25D 23/00*** | (2006.01) |
| ***F25D 23/02*** | (2006.01) |
| ***F25D 23/06*** | (2006.01) |
| ***F25D 25/00*** | (2006.01) |

(52) U.S. Cl.

CPC ..... *F25D 25/025* (2013.01); *F25D 23/006* (2013.01); *F25D 23/021* (2013.01); *F25D 23/069* (2013.01); *F25D 25/005* (2013.01); *F25D 2325/021* (2013.01)

(58) Field of Classification Search

CPC .... F25D 25/025; F25D 25/005; F25D 23/006; F25D 23/021; F25D 23/069

USPC ..... 312/402

See application file for complete search history.

(56) References Cited

U.S. PATENT DOCUMENTS 3,477,679 A * 11/1969 Lovitz ..... A47B 96/061 119/252
4,751,826 A * 6/1988 Kawahara ..... F25D 11/02 62/382
4,816,978 A * 3/1989 Domenget ..... G01S 7/282 323/272

(Continued)

FOREIGN PATENT DOCUMENTS

DE 3802967 * 8/1989
EP 1724540 11/2006

(Continued)

OTHER PUBLICATIONS

Extended European Search Report in European Application No. 18215051.6, dated Jul. 5, 2019, 9 pages.

*Primary Examiner* — Daniel J Troy
*Assistant Examiner* — Timothy M Ayres
(74) *Attorney, Agent, or Firm* — Fish & Richardson P.C.

(57) ABSTRACT

A refrigerator includes a cabinet defining a cabinet storage space, a front panel door part, a drawer part that is located at a rear surface of the front panel door part and that defines a drawer storage space, a drawer cover that partitions the drawer storage space into a front space and a rear space and that covers the rear space, and at least one draw-out rail located at each of both sides of the drawer part. The drawer cover includes a partition part configured to partition the drawer storage space into the front space and the rear space, and a cover part that extends from an upper end of the partition part to a rear end of the drawer part to cover a top of the rear space of the drawer storage space.

7 Claims, 24 Drawing Sheets

(56) References Cited

U.S. PATENT DOCUMENTS 6,742,855 B2 * 6/2004 Whitaker ..... F25D 23/04 312/321.5
7,566,105 B2 * 7/2009 Janda ..... F25D 25/025 312/402
7,669,944 B2 * 3/2010 Oh ..... A47B 51/00 312/330.1
8,152,256 B2 * 4/2012 Kim ..... F25D 25/025 220/345.5
8,517,483 B2 * 8/2013 Eubanks ..... F25D 17/042 312/404
8,668,289 B2 * 3/2014 Lee ..... E05B 17/0033 312/402
9,170,047 B2 * 10/2015 Park ..... F25D 29/005
9,182,168 B2 * 11/2015 Hernandez ..... F25D 25/025
9,389,014 B2 * 7/2016 Rehage ..... F25D 25/025
9,671,154 B1 * 6/2017 Shrader ..... F25D 23/04
9,803,913 B2 * 10/2017 Burke ..... F25D 23/028
10,234,195 B2 * 3/2019 Yasaka ..... B66D 1/12
2010/0192621 A1 8/2010 Kim
2011/0048059 A1 * 3/2011 Song ..... F25D 19/006 62/449
2012/0079845 A1 * 4/2012 Hong ..... F25D 25/025 62/407
2012/0262045 A1 * 10/2012 Cheng ..... F25D 25/025 312/404
2014/0265797 A1 9/2014 Scheuring et al.
2015/0059399 A1 3/2015 Hwang et al.

FOREIGN PATENT DOCUMENTS

EP 2 752 632 A2 * 7/2014
EP 2752632 7/2014
JP 10-197141 * 7/1998
KR 10-2008-0077890 * 8/2008
KR 10-2008-0101335 11/2008
KR 10-2012-0071634 * 7/2012

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2018-0034745, filed on Mar. 26, 2018, No. 10-2018-0038327, filed on Apr. 2, 2018, and No. 10-2018-0038344, filed on Apr. 2, 2018, which are hereby incorporated by reference in their entirety.

BACKGROUND

The present disclosure relates to a refrigerator.

In general, refrigerators are home appliances for storing foods at a low temperature in a storage space that is covered by a door. For this, refrigerators cool the inside of the storage space by using cool air generated by being heat-exchanged with a refrigerant circulated through a refrigeration cycle to store foods in an optimum state.

In recent years, refrigerators have become increasingly multi-functional with changes of dietary lives and gentrification of products, and refrigerators having various structures and convenience devices for convenience of users and for efficient use of internal spaces have been released.

The storage space of the refrigerator may be opened/closed by the door. Also, refrigerators may be classified into various types according to an arranged configuration of the storage space and a structure of the door for opening and closing the storage space.

The refrigerator door may be classified into a rotation-type door that opens and closes a storage space through rotation thereof and a drawer-type door that is inserted and withdrawn in a drawer type.

Also, the drawer-type door is often disposed in a lower region of the refrigerator. Thus, when the drawer-type door is disposed in the lower region of the refrigerator, a user has to turn its back to take out a basket or foods in the drawer-type door. If the basket or the foods are heavy, the user may feel inconvenient to use the drawer-type door or may be injured in use of the drawer-type door.

In order to solve such a limitation, various structures are being developed in which the drawer-type door is capable of being elevated. A prior art document in which an elevation structure of a drawer type door is disclosed is as follows.

1. Publication No (Publication Date): 10-2008-0101335 (Nov. 21, 2008)

2. Title of The Invention: REFRIGERATOR

In the above prior art document, force for the elevation is substantially applied to a front end of the storage container. Also, when foods are stored in the storage container, it is difficult to perform stable elevation of the storage container due to an eccentric load applied to the storage container, and serious deformation and breakage of the door and the storage container may occur.

SUMMARY

Embodiments provide a refrigerator in which a portion of a front part of a drawer door is elevated to reduce a draw-out distance of the drawer door and thereby to simplify a draw-out structure and secure structural safety and a drawer door for a refrigerator.

Embodiments also provide a refrigerator including a drawer cover covering a rear space of a drawer door to secure safety in use when the drawer door ascends and improve an outer appearance and a drawer door for a refrigerator.

Embodiments also provide a refrigerator in which a drawer door is rotatably provided to open a rear space according to a situation and thereby to expand a storage space and a drawer door for a refrigerator.

Embodiments also provide a refrigerator in which when a cover part of a drawer cover rotates, locking of a partition part is automatically released to improve use convenience.

Embodiments also provide a refrigerator in which a tilting basket is provided in a rear space disposed inside a storage space when a drawer door is withdrawn so as to be utilized for storing and a drawer door for a refrigerator.

Embodiments also provide a refrigerator in which a tilting basket provided in a rear space of a drawer door is tilted to improve convenience in storage of a product in the rear space and a drawer door for a refrigerator.

Embodiments also provide a refrigerator in which a drawer cover is detachably provided on a drawer door to allow a user to open and close a rear space as necessary and thereby to improve use convenience and a drawer door for a refrigerator.

Embodiments also provide a refrigerator in which a groove and a protrusion for stably fixing a drawer cover are provided to prevent the drawer cover from being randomly separated and thereby to improve safety of a product and a drawer door for a refrigerator.

Embodiments also provide a refrigerator in which a rear space disposed inside a storage space when a drawer door is withdrawn is selectively opened and closed to be utilized and a drawer door for a refrigerator.

Embodiments also provide a refrigerator including a drawer cover that is capable of opening and closing a rear space through sliding to open the rear space according to user's demands and thereby to expand the storage space and a drawer door for a refrigerator.

Embodiments also provide a refrigerator in which a rear space is partially opened by a plurality of drawer covers to store food in the rear space without separating the drawer cover and a drawer door for a refrigerator.

According to one aspect of the subject matter described in this application, a refrigerator includes: a cabinet that defines a cabinet storage space therein; a front panel door part configured to open and close at least a portion of the cabinet storage space by moving away from and toward the cabinet storage space, respectively, where the front panel door part defines at least a portion of an outer appearance of the refrigerator; a drawer part that is located at a rear surface of the front panel door part, that is configured to insert into the cabinet storage space based on the front panel door part moving toward the cabinet storage space, and that is configured to withdraw from the cabinet storage space based on the front panel door part moving away from the cabinet storage space, where the drawer part defines a drawer storage space therein that has an open top surface; a drawer cover that is located inside of the drawer storage space, that is configured to partition the drawer storage space into a front space and a rear space, and that is configured to cover the rear space; and at least one draw-out rail that is located at each of both sides of the drawer part, that is configured to guide insertion of the drawer part, and that is configured to guide withdrawal of the drawer part to a position in which the front space of the drawer storage space is exposed to an outside of the refrigerator. The drawer cover includes: a partition part configured to partition the drawer storage space into the front space and the rear space; and a cover part that extends from an upper end of the partition part to a rear end of the drawer part to cover a top of the rear space of the drawer storage space.

Implementations according to this aspect may include one or more of the following features. For example, a lower end of the partition part may be detachably mounted to a bottom surface of the drawer part, and a rear end of the cover part may be detachably mounted to an upper end of the drawer part. In some examples, the drawer cover further includes: a first hinge configured to connect a lower end of the partition part to a bottom surface of the drawer storage space, the partition part being configured to rotate about the first hinge; and a second hinge configured to connect the partition part to the cover part, the cover part being configured to rotate about the second hinge.

In some examples, a length of the cover part is less than a length of the partition part, where the cover part is configured to, based on rotating about the second hinge, contact a rear surface of the partition part. In some examples, the cover part is configured to, based on rotating about the second hinge, be seated on a rear surface of the partition part, where the drawer part includes a rear surface that defines a portion of the drawer storage space, the rear surface of the drawer part including an inclined surface that is inclined with respect to the bottom surface of the drawer storage space. The partition part may be configured to, based on rotating about the first hinge, be seated on the inclined surface of the drawer part.

In some implementations, the drawer part includes a rotation restriction protrusion that protrudes from at least one inner surface of the drawer part toward the drawer storage space and that is configured to support at least one end of the partition part. In some implementations, the refrigerator further includes a basket configured to be disposed inside of the rear space of the drawer storage space, and configured to rotate toward the front space of the drawer storage space, where the drawer cover is configured to cover the rear space in a state in which the basket is disposed inside of the rear space.

In some examples, the basket includes: a basket body that defines a basket space configured to store one or more objects; and a rotation protrusion that protrudes from lower ends of the basket body toward inner surfaces of the drawer part, respectively, the rotation protrusion being rotatably mounted to an inside of the drawer part. In some examples, the drawer part includes a plurality of cover fixing protrusions that protrude from an inner side surface of the rear space toward the drawer storage space and that are arranged at positions corresponding to a circumference of the drawer cover. In these examples, the drawer cover may define a plurality of cover protrusion accommodation parts that are located at a side of the drawer cover and that are configured to receive the plurality of cover fixing protrusions, respectively, and the plurality of cover fixing protrusions may be configured to be detachably press-fitted to the plurality of cover protrusion accommodation parts, respectively.

In some implementations, the basket further includes a stopper that protrudes from side surfaces of the basket body toward the inner surfaces of the drawer part, where the stopper is configured to limit a rotation angle of the basket based on contacting one or more of the plurality of cover fixing protrusions in a state in which the basket rotates toward the front space of the drawer storage space. In some examples, the cabinet storage space is defined forward of a machine room of the refrigerator that accommodates a compressor, and the cabinet storage space includes a rear surface that is inclined with respect to a bottom surface of the cabinet and that faces the machine room. The drawer part may include an inclined surface that is located at a rear surface of the drawer part, that is inclined with respect to a bottom surface of the drawer part, and that faces the rear surface of the cabinet storage space. The basket may have a surface that is configured to face the inclined surface of the drawer part, that is inclined corresponding to the inclined surface of the drawer part, and that is configured to be seated on the inclined surface of the drawer part, where the basket defines a basket space that has an upper width greater than a lower width.

In some implementations, the drawer part includes an inclined surface located at a rear surface of the drawer part and that is inclined with respect to a bottom surface of the drawer part. The basket may include: a front surface that is configured to be arranged in a direction perpendicular to the bottom surface of the drawer part; and a rear surface that is inclined corresponding to the inclined surface of the drawer part, where the rear surface of the basket is configured to be seated on the inclined surface of the drawer part.

In some implementations, the drawer cover includes a plurality of drawer covers that are configured to be arranged parallel to each other, that are configured to move in a lateral direction of the drawer part, and that are configured to, based on moving in the lateral direction based on moving in the lateral direction, open and close at least a portion of the rear space of the drawer storage space. In some examples, the drawer part includes a guide rod that extends from an upper end of a rear portion of the drawer part across side surfaces of the rear space of the drawer storage space, that is connected to the plurality of drawer covers, and that is configured to guide a movement of the plurality of drawer covers in the lateral direction.

In some examples, the plurality of drawer covers include one or more guide members, each guide member having a ring shape or a loop shape that allows the guide rod to pass therethrough and that is configured to move along the guide rod to guide the movement of the plurality of drawer covers. In some examples, the guide rod includes one or more bent parts that define at least a portion of a movement path of the plurality of drawer covers, where each of the plurality of drawer covers is configured to pass an adjacent drawer cover among the plurality of drawer covers based on moving along the movement path.

In some implementations, the plurality of drawer covers are configured to cover the rear space of the drawer storage space in a state in which ends of the plurality of drawer covers contact each other, where the ends of the plurality of drawer covers are configured to face each other and have a round shape or an inclined shape that enables each of the plurality of drawer covers to overlap another drawer cover of the plurality of drawer covers based on one or more drawer covers moving in the lateral direction.

In some implementations, the refrigerator further includes: a motor located inside of the cabinet storage space; a pinion located inside of the cabinet storage space and configured to be rotated by the motor; and a draw-out rack that is located inside of the cabinet storage space, that is coupled to the pinion by gears, and that is configured to insert the drawer part to the cabinet storage space and to withdraw the drawer part from the cabinet storage space. The draw-out rack may be configured to withdraw the drawer part from the cabinet storage space to a position in which an entire portion of the front space of the drawer storage space is exposed to the outside of the refrigerator, and in which the rear space of the drawer storage space remains inside of the cabinet storage space.

In some implementations, the at least one draw-out rail defines a maximum withdrawal distance that allows at least a portion of the drawer cover to remain in the cabinet storage space in a state in which the drawer part is withdrawn from the cabinet storage space. In some implementations, the refrigerator further includes: an elevation assembly located at the front space of the drawer storage space and configured to elevate one or more objects stored in the drawer part relative to the drawer part; and a driving device that is located at the rear surface of the front panel door part and that is configured to provide power to the elevation assembly to cause the elevation assembly to elevate the one or more objects stored in the drawer part relative to the drawer part. The driving device may be configured to pass through a front surface of the drawer part and to connect to the elevation assembly.

The details of one or more embodiments are set forth in the accompanying drawings and the description below. Other features will be apparent from the description and drawings, and from the claims.

DETAILED DESCRIPTION OF THE EMBODIMENTS

Hereinafter, detailed embodiments of the present disclosure will be described in detail with reference to the accompanying drawings. However, the scope of the present disclosure is not limited to proposed embodiments, and other regressive inventions or other embodiments included in the scope of the spirits of the present disclosure may be easily proposed through addition, change, deletion, and the like of other elements.

Figure 1:
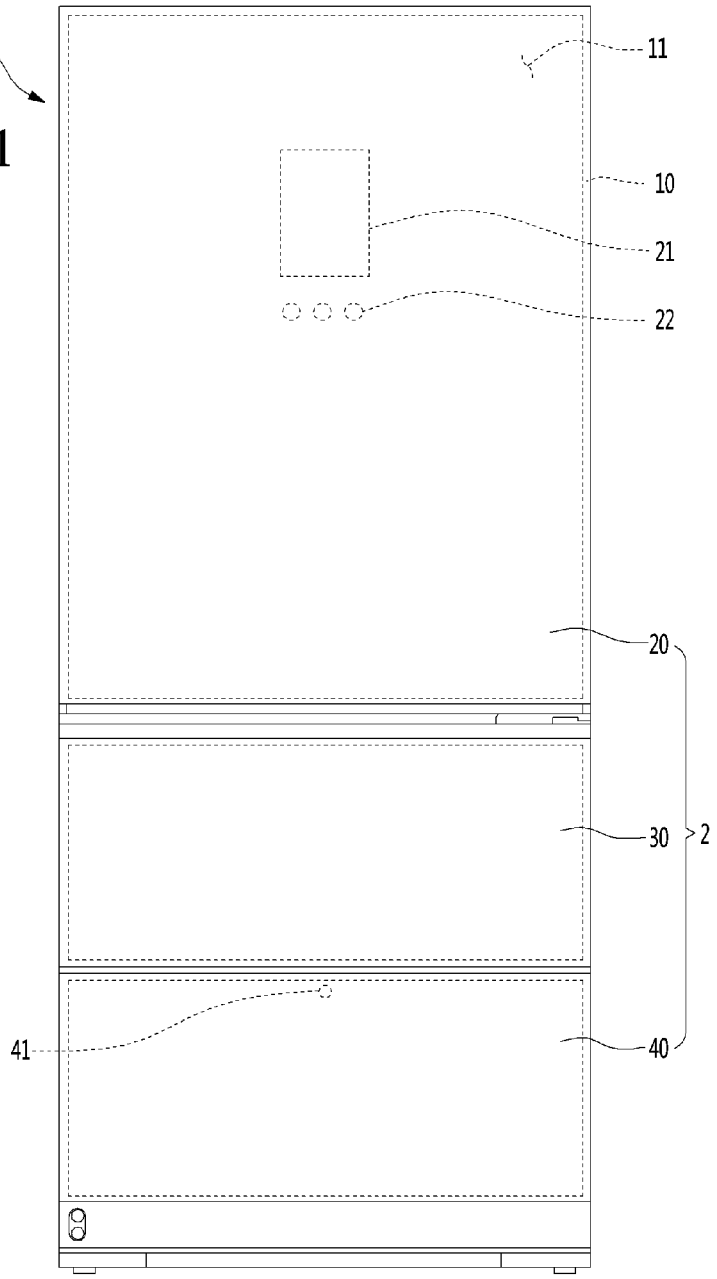
FIG. 1 is a front view of a refrigerator according to an embodiment.

FIG. 1 is a front view of a refrigerator according to an embodiment.

Referring to FIG. 1, a refrigerator 1 may have an outer appearance that is defined by a cabinet 10 defining a cabinet storage space 11 and a door 2 covering an opened front surface of the cabinet 10.

The cabinet storage space 11 of the cabinet 10 may be divided into a plurality of spaces. For example, the cabinet storage space 11 may be divided into an upper storage space of the cabinet 10 that is provided as a refrigerating compartment, and a lower storage space of the cabinet 10 that is provided as a freezing compartment. The cabinet storage space 11 may be divided into an independent space having a different temperature except for the refrigerating compartment or the freezing compartment.

The door 2 may be constituted by a rotation door 20 opening and closing the upper storage space through rotation thereof and drawer doors 30, 40 opening and closing the lower storage space by being inserted or withdrawn in a drawer type. The lower space may be vertically divided again. The drawer doors 30 and 40 may be constituted by an upper drawer door 30 and a lower drawer door 40. Also, an outer appearance of each of the rotation door 20 and the drawer doors 30 and 40 may be made of a metal material.

Although the refrigerator in which all of rotation door 20 and the drawer doors 30 and 40 are provided is described, the present disclosure is not limited thereto. For example, the present disclosure may be applied to all refrigerators including a door that is inserted and withdrawn in the drawer type.

A display 21 may be disposed on one side of a front surface of the rotation door 20. The display 21 may have a liquid crystal display structure or a multi-segment display such as a seven-segment display or an "88" shape segment structure. Also, when the outer appearance of the door is made of the metal material, a plurality of fine holes are punched in the display 21 to display information by using light passing therethrough.

Also, a manipulation part 22 for manipulating automatic rotation of the door may be provided on one side of the rotation door 20. The manipulation part 22 may be integrated with the display and may operate in a touch manner or a button manner. The manipulation part 22 may input an overall operation of the refrigerator 1 and manipulate an insertion and withdrawal of the drawer doors 30 and 40 or an elevation of an elevation assembly 63 within the lower drawer door 40.

A manipulation part 41 may also be provided on the lower drawer door 40. For example, a drawer manipulation part 41 may be disposed on one side of the lower drawer door 40.

The drawer manipulation part 41 may operate in a touch or button manner. The manipulation part 41 may be provided as a sensor detecting proximity or movement of a user or provided as an input unit that operates by a user's motion or voice.

A manipulation device 42 may be disposed on a lower end of the lower drawer door 40 to illuminate an image on a bottom surface and thereby to output a virtual switch and to input an operation in such a manner that the user approaches a corresponding area.

The lower drawer door 40 may be automatically inserted and withdrawn according to the manipulation of the drawer manipulation part 41. Also, a food or storage container 70 within the lower drawer door 40 may be elevated in a state in which the lower drawer door 40 is withdrawn by the manipulation of the manipulation part 42.

The storage container 73 may have a basket shape having an opened top surface. If necessary, the storage container 73 may have various plate shapes including one surface on which the food is supported. Also, the storage container 73 may have a shape having both side surfaces coupled to the elevation assembly 63. The storage container 70 may be elevated by the elevation assembly 63 and thus may be called an elevation member.

Hereinafter, the lower drawer door 40 will be described in more detail, and also, the lower drawer door 40 will be called a 'drawer door' unless otherwise specified.

Figure 2:
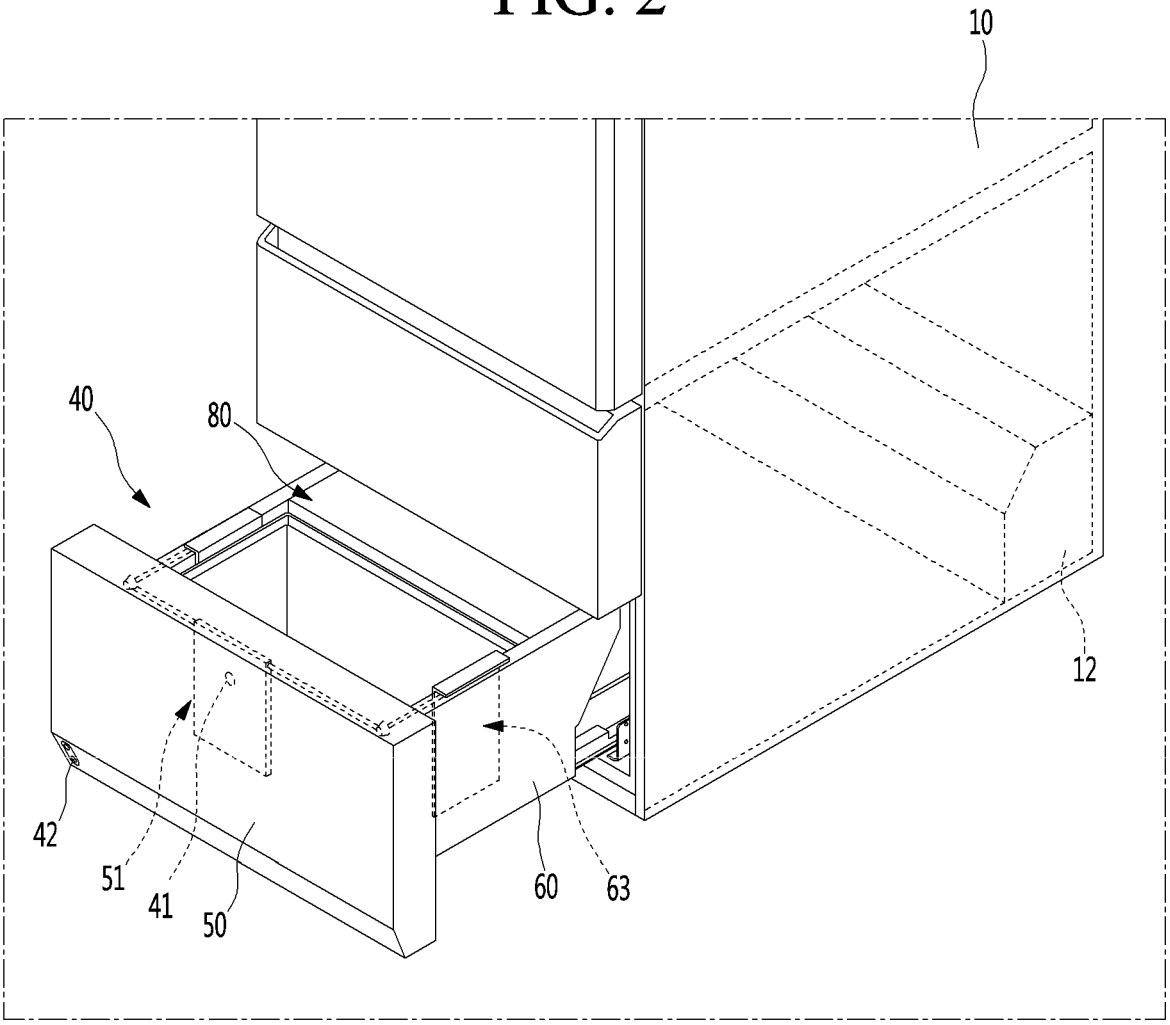
FIG. 2 is a perspective view illustrating a state in which a drawer door is withdrawn according to an embodiment.
Figure 3:
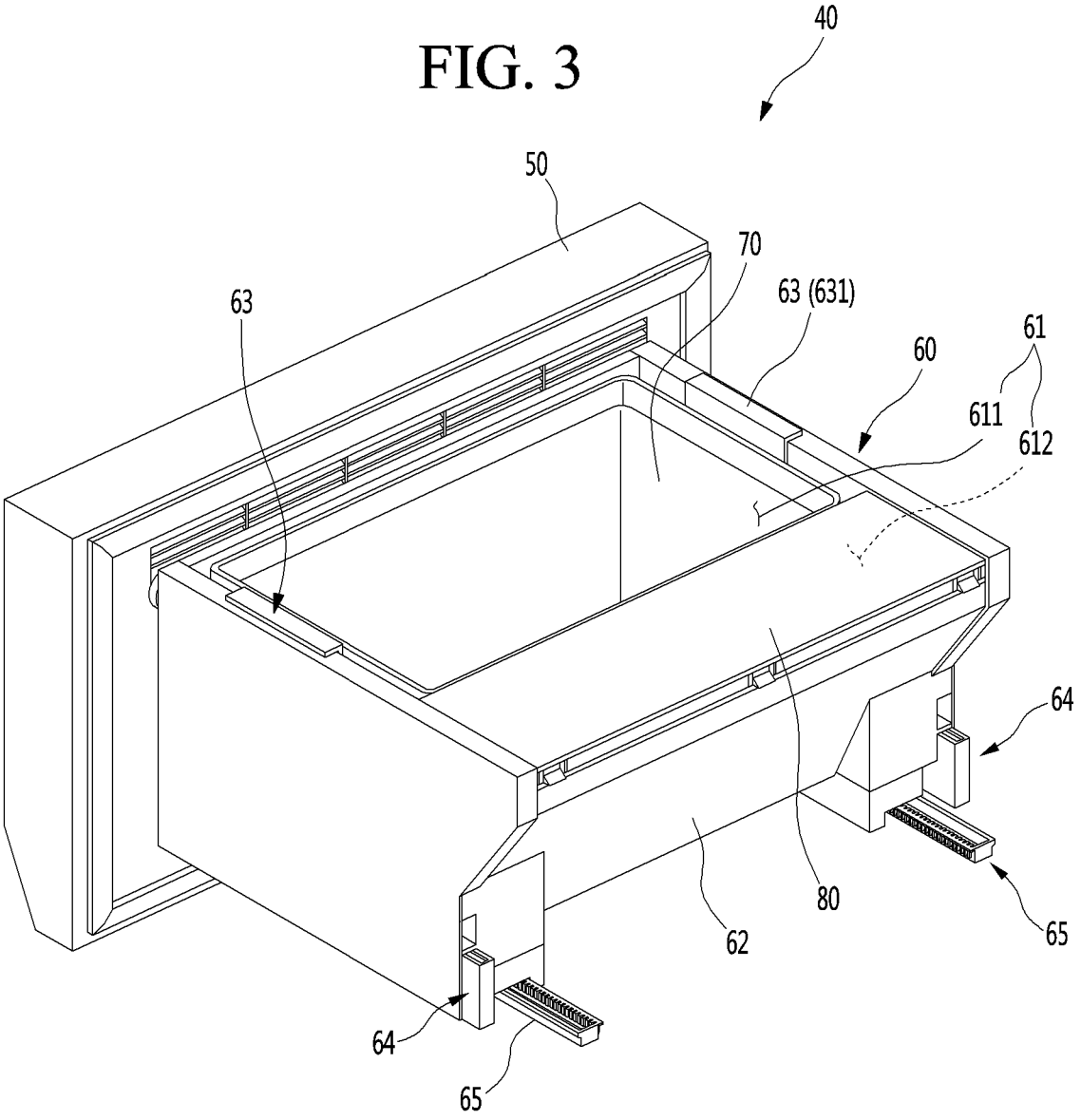
FIG. 3 is a perspective view of the drawer door according to an embodiment.
Figure 4:
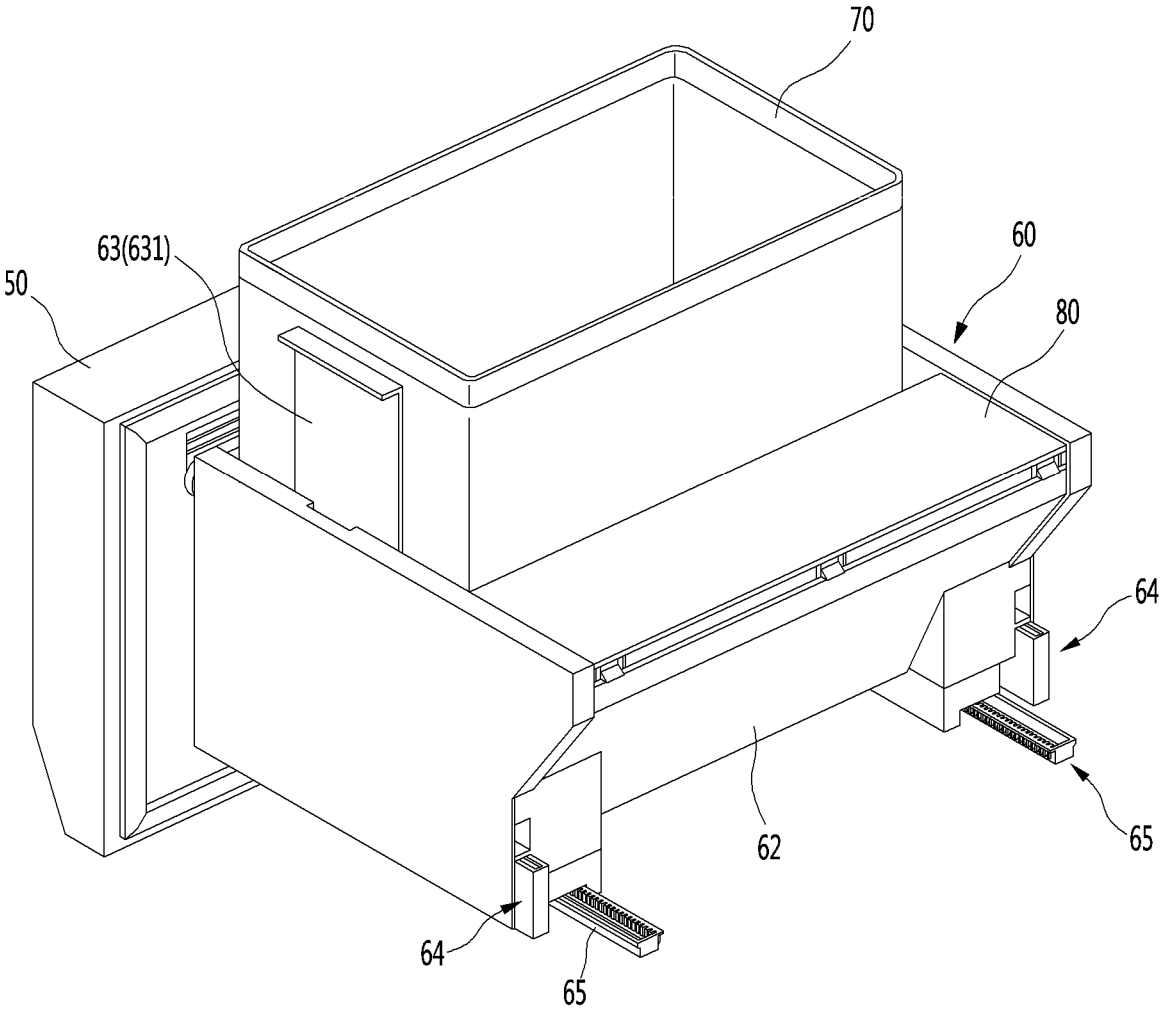
FIG. 4 is a perspective view illustrating a state in which a storage container ascends in the drawer door of FIG. 3.
Figure 5:
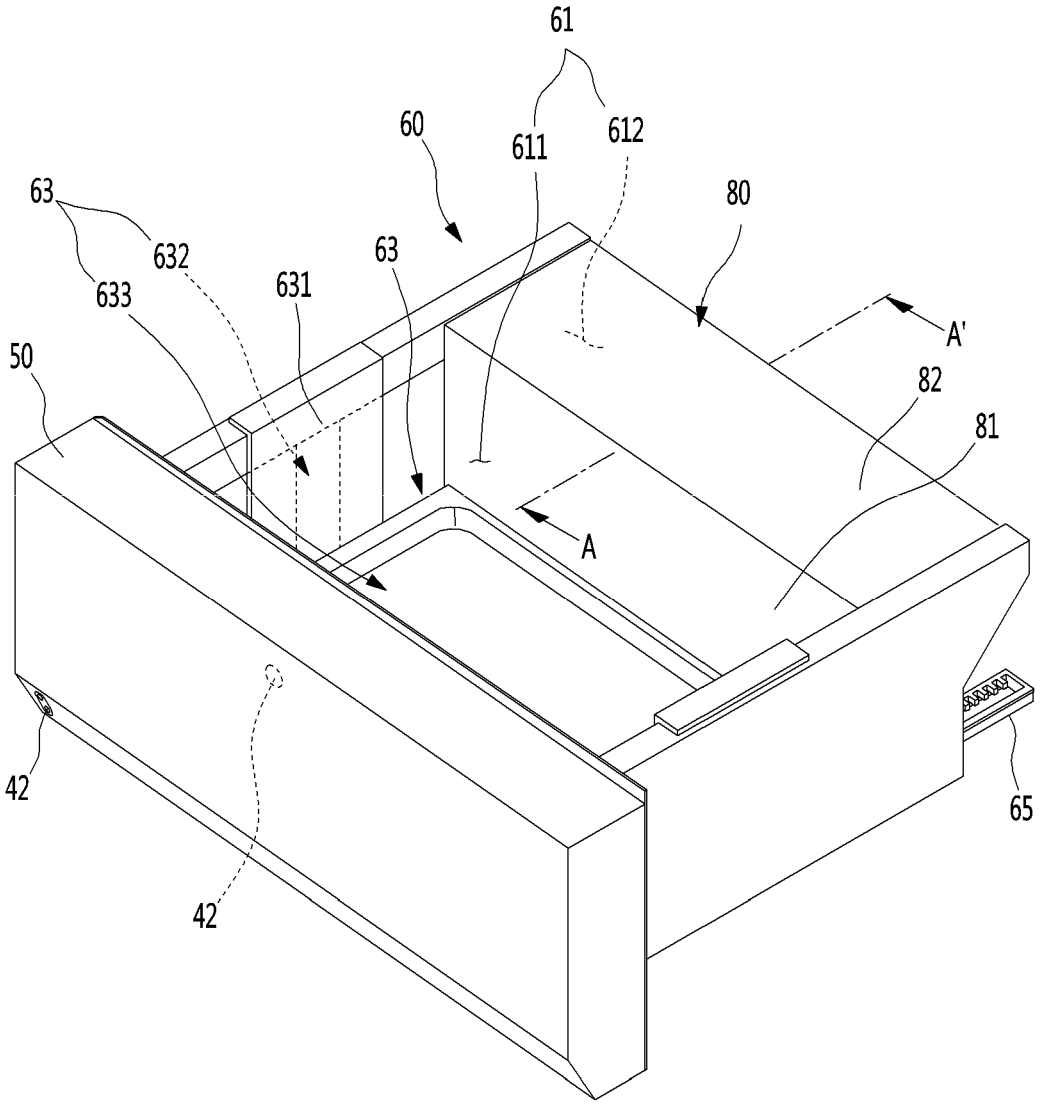
FIG. 5 is a perspective view illustrating a state in which a drawer cover covers a rear space according to an embodiment.

FIG. 2 is a perspective view illustrating a state in which the drawer door is withdrawn according to an embodiment. FIG. 3 is a perspective view of the drawer door according to an embodiment. FIG. 4 is a perspective view illustrating a state in which the storage container is separated from the drawer door of FIG. 3. Also, FIG. 5 is a perspective view illustrating a state in which the drawer cover covers a rear space according to an embodiment.

Referring to FIGS. 2 to 5, the lower drawer door 40 may include a front panel door part 50 defining an outer appearance of a front surface thereof and opening and closing at least a portion of the cabinet storage space 11 (i.e., a lower storage space) and a drawer part 60 coupled to a rear surface of the front panel door part 50 and inserted and withdrawn together with the front panel door part 50.

The front panel door part 50 may be exposed to the outside of the cabinet 10 to define an outer appearance of the refrigerator 1, and the drawer part 60 may be disposed inside the cabinet storage space 11 within the cabinet 10. Also, the front panel door part 50 and the drawer part 60 may be coupled to each other and inserted and withdrawn together with each other.

The drawer part 60 may be disposed on the rear surface of the front panel door part 50 to define a space in which the food or storage container to be stored is accommodated. A drawer storage space 61 that is opened upward may be provided in the drawer part 60, and an outer appearance of the outside of the drawer part 60 may be defined by a plurality of plates. The plurality of plates may be made of a metal material such as stainless steel. The outside of the drawer part 60 may be made of a stainless steel or a material having a texture such as stainless steel.

In the state in which the lower drawer door 40 is inserted, a machine room 12 in which a compressor and a condenser constituting a refrigeration cycle are provided may be disposed behind the lower drawer door 40. The machine room 12 may be provided in the cabinet 10.

A rear surface of the cabinet storage space 11 corresponding to the machine room 12 may be inclined. However, the rear surface of the cabinet storage space 11 is not limited thereto. For example, the rear surface of the cabinet storage space 11 may be inclined or reduced by a space in which the machine room 12 is disposed.

Thus, a rear part of the drawer part 60 may have an upper end that further protrudes from a lower end by the machine room 12. Thus, the rear surface of the drawer part 60 may have an inclined surface 62 corresponding to the rear surface of the cabinet storage space 11.

A draw-out rail 64 may be disposed on a bottom surface of the drawer part 60. The draw-out rail may connect the cabinet storage space 11 to the drawer doors 30 and 40 and extend in multistage to guide the insertion and withdrawal of the drawer doors 30 and 40.

The draw-out rail 64 may be disposed on a lower portion of each of both left and right surfaces of the drawer part 60 and covered by the plates defining the outer appearance of the drawer part 60. A different constituent that is capable of guiding the insertion and withdrawal of the drawer door except for the draw-out rail 64 may be provided in the drawer part 60.

Also, a draw-out motor and a pinion connected to the draw-out motor may be provided in the cabinet storage space 11, and a draw-out rack 65 coupled to the pinion to allow the drawer door to be automatically inserted and withdrawn may be provided on a bottom surface of the drawer part 60.

That is, in the case in which the draw-out motor is provided in the cabinet 10, the automatic insertion and withdrawal of the lower drawer door 40 may be enabled by the draw-out rack 65 interlocked with the driving of the draw-out motor. That is, when the drawer manipulation part 41 is manipulated to be inputted, the draw-out motor may be driven, and the pinion may move along the draw-out rail 64 to allow the drawer door 40 to be inserted and withdrawn.

The draw-out rail 64 may not be provided on the drawer part 60. Here, the user may hold a side of the front panel door part 50 to push and pull the front panel door part 31 so that the lower drawer door 40 is inserted and withdrawn.

Since the machine room 12 is provided behind the lower drawer door 40, the draw-out rack 65 may have a relatively short length. Thus, the entire drawer door 40 may not be withdrawn to the outside of the cabinet 10, and a portion of the drawer part 60 may be exposed to the outside of the cabinet 10.

Here, a draw-out distance of the drawer door 40 may be secured within a distance in which a seating member 633 or the storage container 70, which is provided in the front part of the drawer part 60, is completely withdrawn, and the draw-out rack 65 that is relatively short by the machine room 12 may also be sufficiently withdrawn.

Also, the draw-out rail 64 may also extend in multistage. Thus, the draw-out rail may have a simple structure corresponding to the relatively reduced draw-out distance, which is required for the withdrawal of the drawer door 40.

The drawer storage space 61 may be divided into a front space 611 and a rear space 612. The elevation assembly 63 that is vertically elevated and a storage container 70 seated on the elevation assembly 63 to be elevated together with the elevation assembly 63 may be disposed in the front space 611. Although the storage container 70 is illustrated in the form of a basket having an opened upper portion, the storage container 70 may have a closed box structure such as a kimchi box. Also, a plurality of storage containers 70 may be stacked or arranged in parallel to each other.

However, the food may be directly mounted on the elevation assembly 63 without the storage container 70.

Hereinafter, a structure in which the storage container 70 is accommodated in the elevation assembly 63 will be described as an example.

Also, a driving device 51 including an electric device such as a motor for the elevation of the elevation assembly 63 may be disposed in the front panel door part 50. A mechanism part that is elevated by power transmitted from the driving device, i.e., the elevation assembly 63 may be disposed in the drawer part 60. The mechanism part may be disposed on both the left and right sides of the drawer part 60 and may be covered by a side cover 631 included in the elevation assembly 63 without being exposed to the outside. The driving device 51 and the elevation assembly 63 may be connected to each other by a shaft to cross each other, and uniform power may be transmitted to both sides through gear coupling.

The elevation assembly 63 may include an elevation device 632 provided on both the left and right sides of the drawer part 60 and a seating member 633 disposed on the bottom surface of the front space 611. The elevation device 632 may be mounted on both the right and left sides of the drawer part 60 and may have a structure in which a portion of the elevation device 632 moves by the power transmitted from the elevation motor disposed in the front panel door part 50. The elevation device may have various structures, which is capable of being elevated, such as a rail structure or a screw shaft structure.

Also, the elevation device 632 is coupled to a central portion of each of both left and right ends of the seating member 633. Thus, the seating member 633 may vertically move by the elevation device 632, and the storage container 70 or the food seated on the seating member 633 may be elevated. The elevation devices 632 provided on both the left and right sides may operate at the same time and may be configured to move at the same height. Thus, the seating member 633 may be elevated in a horizontal state without being tilted to one side of the right and left sides.

When the drawer door 40 is withdrawn, the drawer door 40 may be withdrawn at a distance that allows at least the seating member 633 to be disposed outside the cabinet storage space 11, and when the elevation device 632 is driven, the storage container or food seated on the seating member 633 may be prevented from colliding with the doors 20 and 30 or the cabinet 10.

As described above, when the drawer door 40 is withdrawn, the entire drawer part 60 may not be withdrawn to the outside of the cabinet storage space 11 due to a limitation in draw-out distance of the drawer door 40. That is, at least the front space 611 is withdrawn to the outside of the cabinet storage space 11, and the whole or a portion of the rear space 612 is disposed inside the cabinet storage space 11. Also, the draw-out distance of the drawer door 40 may be limited by the draw-out rail 64 or the draw-out rack 65.

The lower drawer door 40 is provided with various components for elevating the elevation assembly 63. As the draw-out distance increases, moment applied to the lower drawer door 40 increases. Thus, it may be difficult to maintain the stable state, and it may cause deformation or breakage of the draw-out rail 64.

However, the drawer door 40 is configured to have a limited draw-out distance at which the storage container 70 and food accommodated in the front space 611 are elevated without collision with the drawer door 40 and to prevent the draw-out rail from being deformed or damaged and also damaged due to the movement of the center of gravity.

A separate drawer cover 80 may be provided in the rear space 612. The front space 611 and the rear space 612 may be partitioned by the drawer cover 80. Also, the drawer cover 80 may cover the front and top surfaces of the rear space 612, and thus, the rear space 612 may be unused space. However, the drawer cover 80 may rotate to open the rear space 612, and the food may be stored in the rear space 612.

Next, the structure in which the drawer cover 80 opens and closes the rear space 612 will be described in detail.

Figure 6:
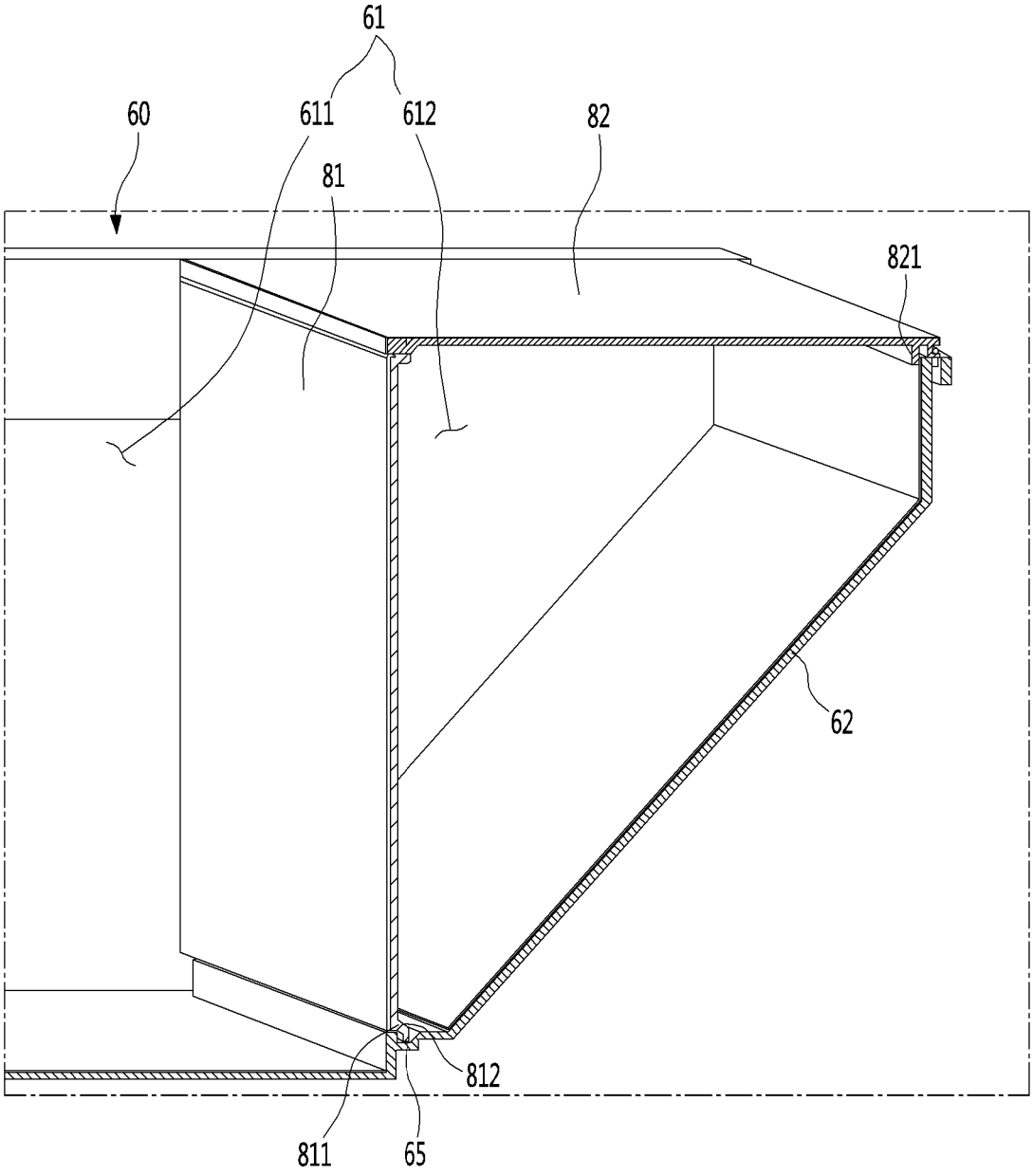
FIG. 6 is a cross-sectional view taken along line A-A' of FIG. 5.
Figure 7:
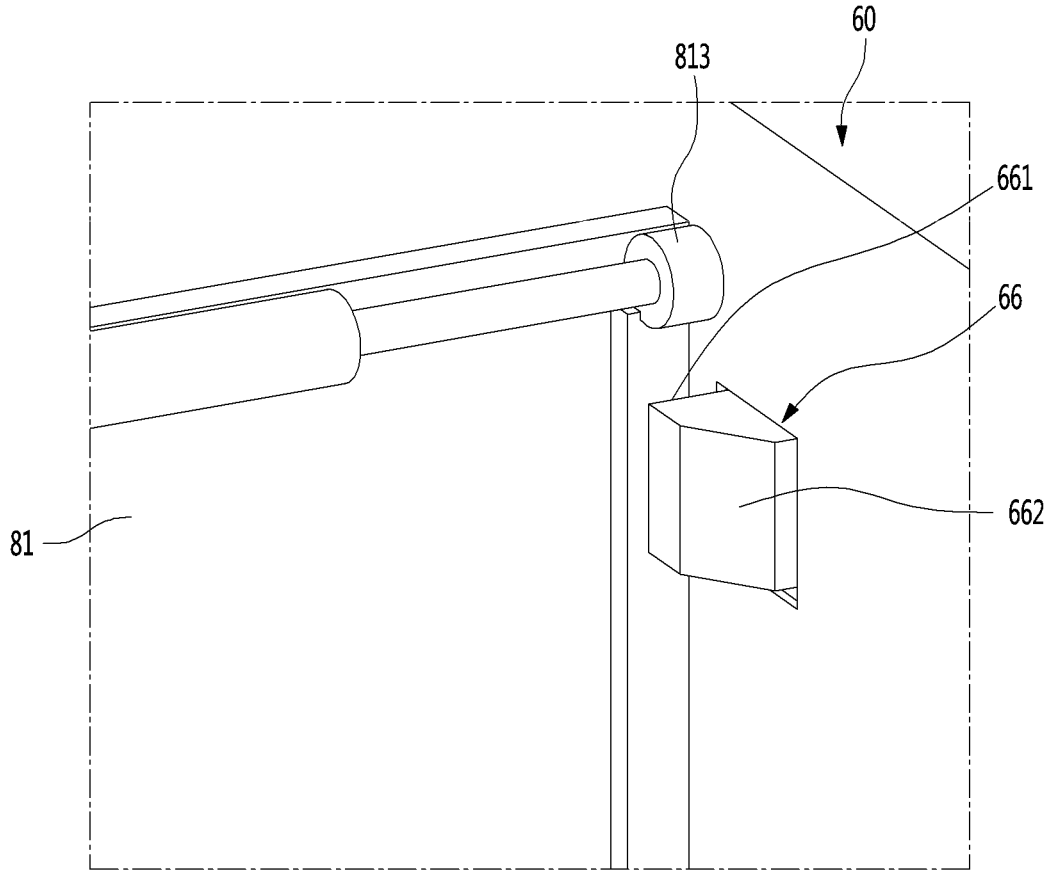
FIG. 7 is a perspective view of a rotation restriction protrusion according to an embodiment.
Figure 8:
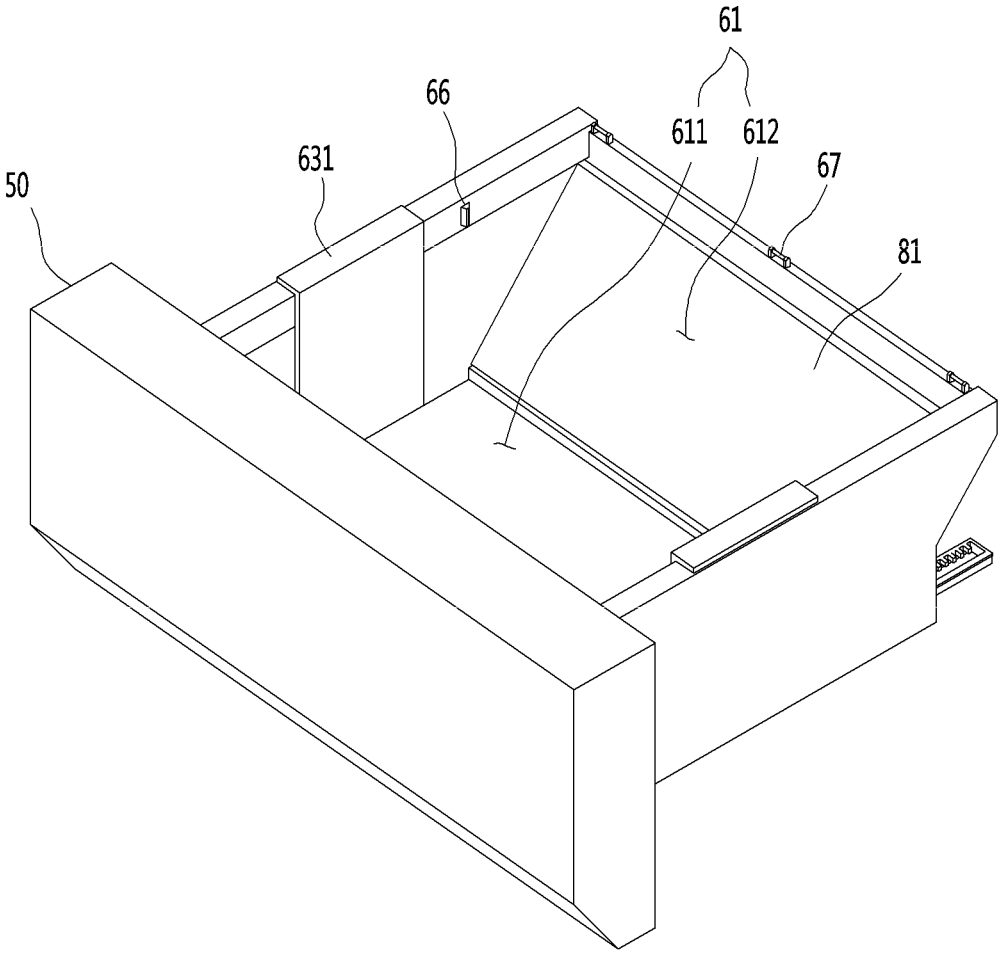
FIG. 8 is a perspective view illustrating a state in which the drawer cover rotates to open the rear space according to an embodiment.

FIG. 6 is a cross-sectional view taken along line A-A' of FIG. 5. FIG. 7 is a perspective view of a rotation restriction protrusion according to an embodiment. FIG. 8 is a perspective view illustrating a state in which the drawer cover rotates to open the rear space according to an embodiment.

Referring to FIGS. 6 to 8, the drawer cover 80 may include a partition part 81 for partitioning the front space 611 and the rear space 612 and a cover part 82 for covering the upper surface of the rear space 612. The partition part 81 may be called a front part or a vertical part, and the cover part 82 may be called a top part or a horizontal part according to structural characteristics of the drawer cover 80.

The overall shape of the partition part 81 may be a rectangular shape, for example, and extend to the upper end of the drawer part 60. Also, the partition part 81 may be vertically provided in a boundary between the front space 611 and the rear space 612 in the drawer storage space 61 so as to partition the front space 611 and the rear space 612.

A first hinge is provided at a lower end of the partition part 81 so that the partition part 81 is rotatably connected to the bottom surface of the drawer storage space 61.

The partition part 81 may further include a first bent part 811 bent backward from the lower end and a second bent part 812 bent downward from the first bent part 811. Also, an accommodation groove 65 that is recessed downward to accommodate the second bent part 812 may be defined in the drawer storage space 61.

Figure 17:
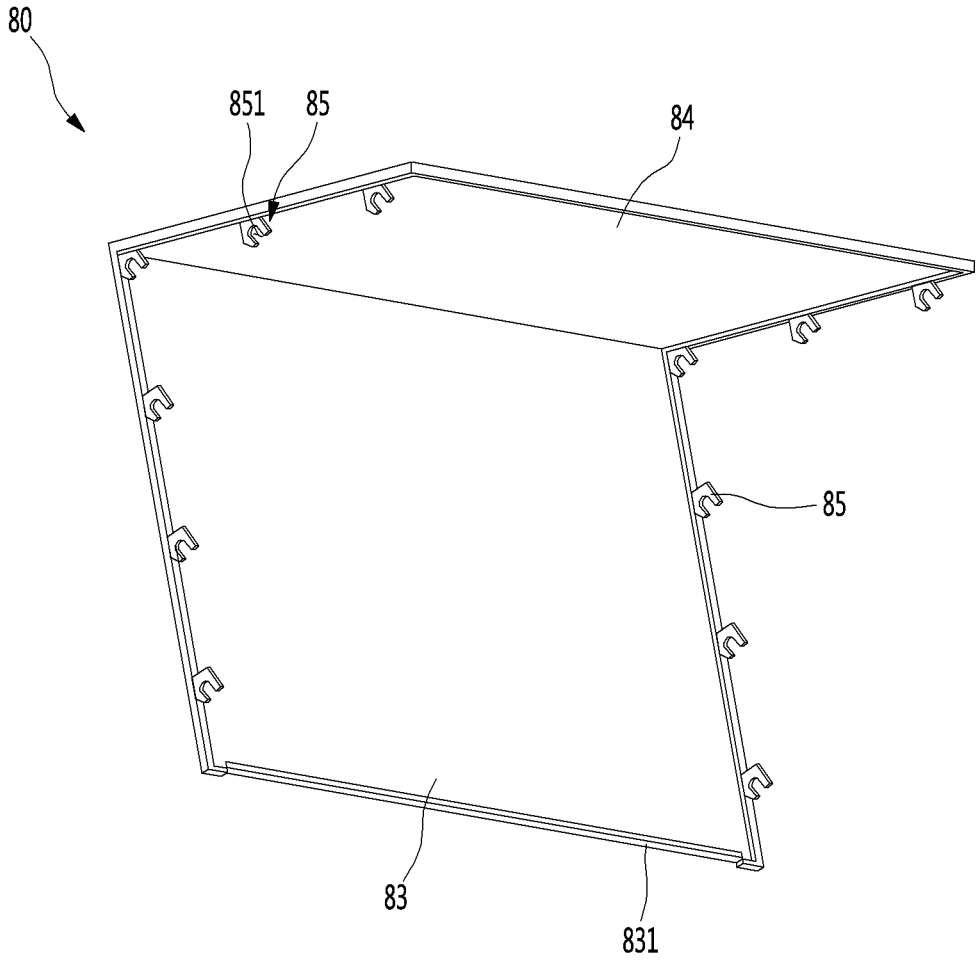
FIG. 17 is a rear perspective view of the drawer cover.

Although not shown in detail, a lower end of the partition part 81 and the bottom surface of the drawer storage space 61 are substantially axially coupled to each other to rotate like a second hinge 813 of FIG. 17. If necessary, the first hinge may have a structure in which the second bent part 812 is rotatably inserted into the accommodation groove 65 or may be referred to as a lower end of the second bent part 812. The first hinge may have a different structure in which the lower end of the partition part 81 is rotatably coupled to the drawer storage space 61.

When the first hinge provided on the lower end of the second bent part 812 is connected to the accommodation groove 65, the first bent part 811 and the second bent part 812 may be seated on a front end of the accommodation groove 65 to limit an angle at which the partition part rotates forward. When a recessed depth of the accommodation groove 65 and a length of the second bent part 812 are the same, the partition part 81 may be restricted to rotate until the partition part 81 is perpendicular to the drawer storage space 61.

A rotation restriction protrusion 66 for restricting the rotation of the partition part 81 backward may be provided on a side surface of the drawer storage space 61. When the partition part 81 is vertically disposed to partition the front space 611 and the rear space 612, the rotation restriction protrusion 66 may be disposed at a rear side to support a rear surface of the partition part 81.

In detail, the rotation restriction protrusion 66 is provided with a metal plate in which a hole is defined in an inner surface of the drawer storage space 61, and the rotation restriction protrusion 66 may protrude inward through a hole.

Thus, the rotation restriction protrusion 66 may protrude to the inside of the drawer storage space 61 to support the rear end of the partition part 81 when the partition part 81 partitions the drawer storage space 61.

Also, the rotation restriction protrusion 66 may be pressed to move to the outside of the drawer storage space 61 so as not to support the rear end of the partition part 81 when the partition part 81 needs to rotate. This means that the rotation restriction protrusion 66 moves to a position at which the rotation restriction protrusion does not interfere with a rotation path of the partition part 81 when the rotation of the partition part 81 is required. Thus, according to the design, the rotation restriction protrusion 66 may be disposed inside the drawer storage space 61 without moving outside when the rotation restriction protrusion 66 is pressed.

When the rotation restriction protrusion 66 is pressed, the spring is compressed. When the pressing force is removed, the spring is restored, and the rotation restriction protrusion 66 may return to its original position.

At least one rotation restriction protrusion 66 may be provided. When the plurality of rotation restriction protrusions 66 are provided, the rotation restriction protrusions may be parallely disposed on both sides of the drawer storage space 61 or vertically arranged on one side. Alternatively, a plurality of rotation restriction protrusions may be vertically arranged on both sides.

The surface on which the rotation restriction protrusion 66 supports the partition part 81 may be called a support surface 661 Also, a protrusion inclined surface 662 may be disposed on the other side of the support surface 661. The rear end of the protrusion inclined surface 662 may be adjacent to the drawer storage space 61 and may be inclined so as to be further away from the drawer storage space 61 toward the front end. This configuration is such that the rotation restriction protrusion 66 is automatically pressed to move toward the outside of the drawer storage space 61 by the rotation of the cover part 82 which will be described later.

The cover part 82 may extend from the top surface of the partition part 81 to the top surface of the rear side of the drawer part 60 and may be seated on the top surface of the partition part 81 and the top surface of the rear side of the drawer part 60. Also, the cover part 82 may be disposed at the same height as the upper end of each of both side surfaces of the drawer part 60.

Thus, the partition part 81 and the cover part 82 may cover the rear space 612. Since the top surface of the rear space 612 has a rectangular shape in an embodiment, the cover part 82 may have a rectangular shape. However, the shape of the cover part 82 is not limited thereto.

The cover part 82 and the partition part 81 may be connected to each other through a second hinge 813. In detail, the cover part 82 may be seated on the upper end of the partition part 81, and the second hinge 813 may be disposed on the upper end of the rear surface of the partition part 81 and the bottom surface of the cover part 82.

The cover part 82 may have a length less than that of the partition part 81. Also, the cover part may rotate to contact the rear surface of the partition part 81 by using the second hinge 813 as an axis.

The second hinge 813 may be disposed at a position spaced a predetermined distance from the bottom surface of the cover part 82 backward from the front end thereof. Thus, the front end of the cover part 82 may rotate in a state of being seated on the top surface of the partition part 81, and the second hinge 813 may not be exposed to the outside to improve an aesthetic appearance.

The cover part 82 may rotate downward by using the second hinge 813 as an axis. Also, a maximum angle at which the cover part 82 rotates may be about 90 degrees, and also, the cover part 82 may rotate toward partition part 81. Thus, the cover part 82 may be parallel to the partition part 81.

Also, while the cover part 82 rotates, the protrusion inclined surface 662 may be pressed. Thus, when the rotation of the cover part 82 is completed, the rotation restriction protrusion 66 may move by the cover part 82 and then be disposed outside a rotation path of the partition part 81. Thus, as the cover part 82 rotates, the restriction of the rotation restriction protrusion 66 supporting the rear end of the partition part 81 may be automatically released.

The front surface of the cover part 82 may extend to be continued with the front surface of the partition part 81, thereby giving a sense of unity of the product and improving the outer appearance.

The rear end of the cover part 82 may be seated and fixed on the upper end of the drawer part 60. A hook protrusion 821 protruding downward may be disposed on a rear bottom surface of the cover part 82. Also, the hook protrusion 821 may contact a rear surface of the inside of the drawer part 60. Thus, the hook protrusion 821 may restrict a backward movable distance of the cover part 82 after the cover part 82 is seated on the upper end of the drawer part 60.

Also, a fixing structure for fixing the cover part 82 to the drawer part 60 may be provided. For example, a protrusion for fixing may be disposed on the rear upper end of the drawer part 60, and a fixing structure hooked with the protrusion may be disposed on the cover part 82. The fixing structure of the cover part 82 and the drawer part 60 will be described in detail with reference to FIGS. 9 and 10.

Figure 9:
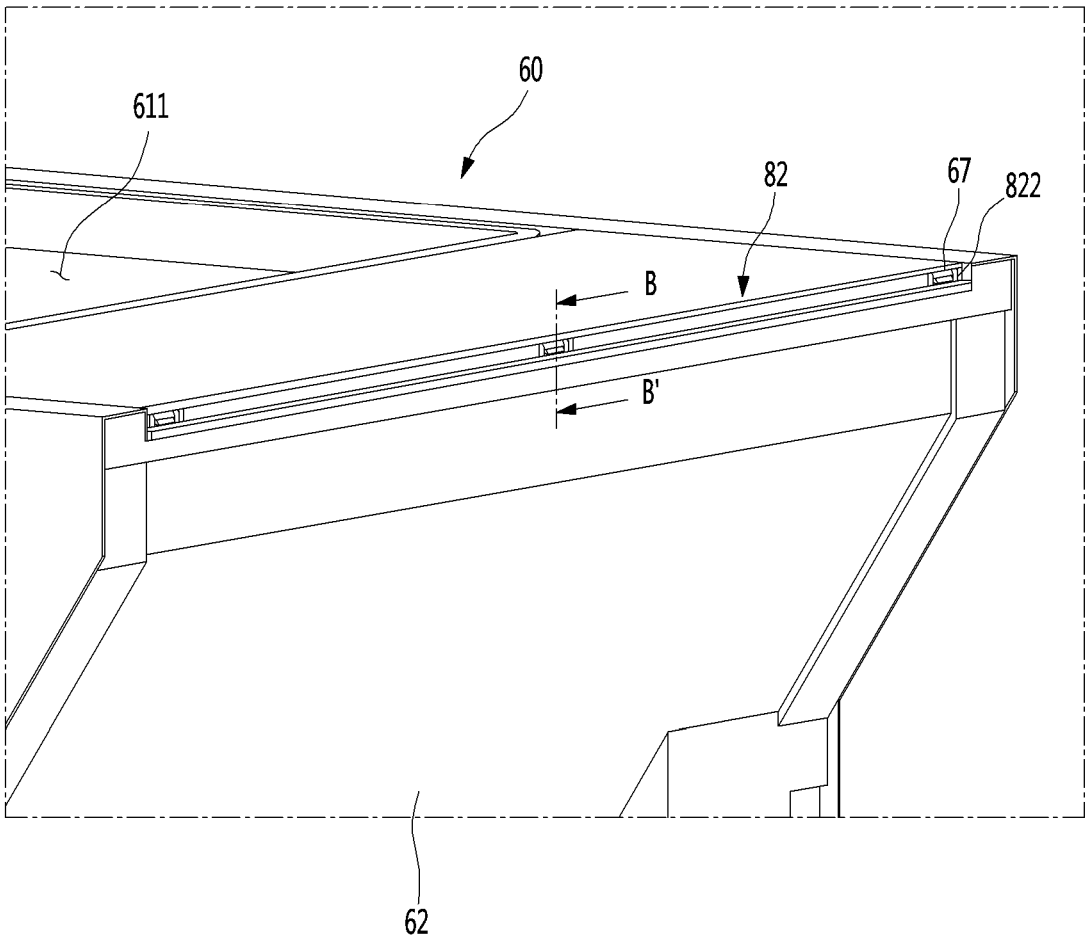
FIG. 9 is a perspective view illustrating a fixing structure of a cover part and a drawer part according to an embodiment.
Figure 10:
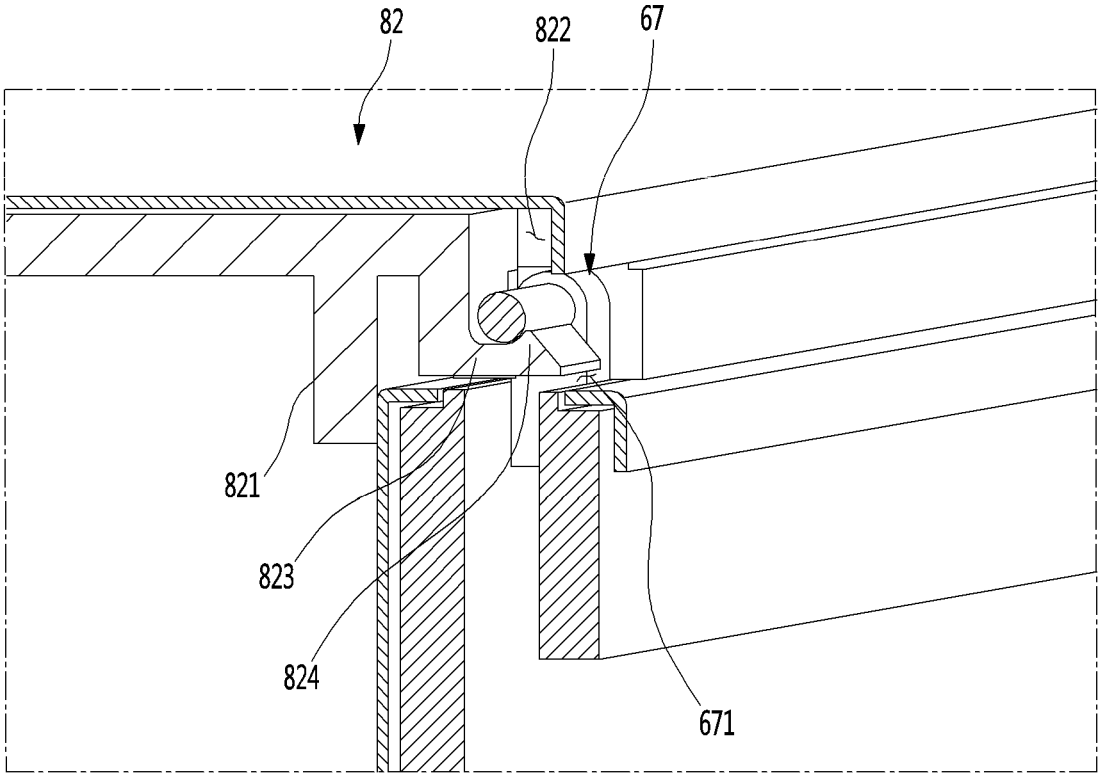
FIG. 10 is a sectional view taken along line B-B' of FIG. 9.

FIG. 9 is a perspective view illustrating a fixing structure of the cover part and the drawer part according to an embodiment. FIG. 10 is a sectional view taken along line B-B' of FIG. 9.

Referring to FIGS. 9 and 10, a fixing protrusion 67 protruding upward and having a through-hole 671 penetrated in the front and rear direction may be disposed on the rear upper end of the drawer part 60. In an embodiment, the fixing protrusion 67 may be provided with two protrusion columns vertically protruding upward and spaced a predetermined distance from each other in parallel to each other and a connection part connecting the protrusion columns to each other, but is not limited thereto.

Also, a protrusion accommodation groove 822 in which the fixing protrusion 67 is accommodated may be defined in the rear end of the cover part 82. Also, a penetration extension part 823 extending backward to pass through the through-hole 671 and a hook part 824 extending upward from a rear portion of the penetration extension part 823 may be provided in the protrusion accommodation groove 822.

Thus, when the fixing protrusion 67 is accommodated in the protrusion accommodation groove 822, the fixing protrusion 67 may be hooked with the hook part 824. Thus, the cover part 82 may be fixed to the drawer part 60. The fixing of the cover part 82 and the drawer part 60 may be released through movement of the hook part 824 in a hook release direction.

Each of the fixing protrusion 67, the accommodation groove 65, the penetration extension part 823, and the hook part 824 may be provided in plurality. For example, three parts may be disposed at left, central, and right sides.

Hereinafter, a process of opening the rear space 612 through rotation of the drawer cover 80 will be described in detail with reference to FIGS. 11 to 13.

Figure 11:
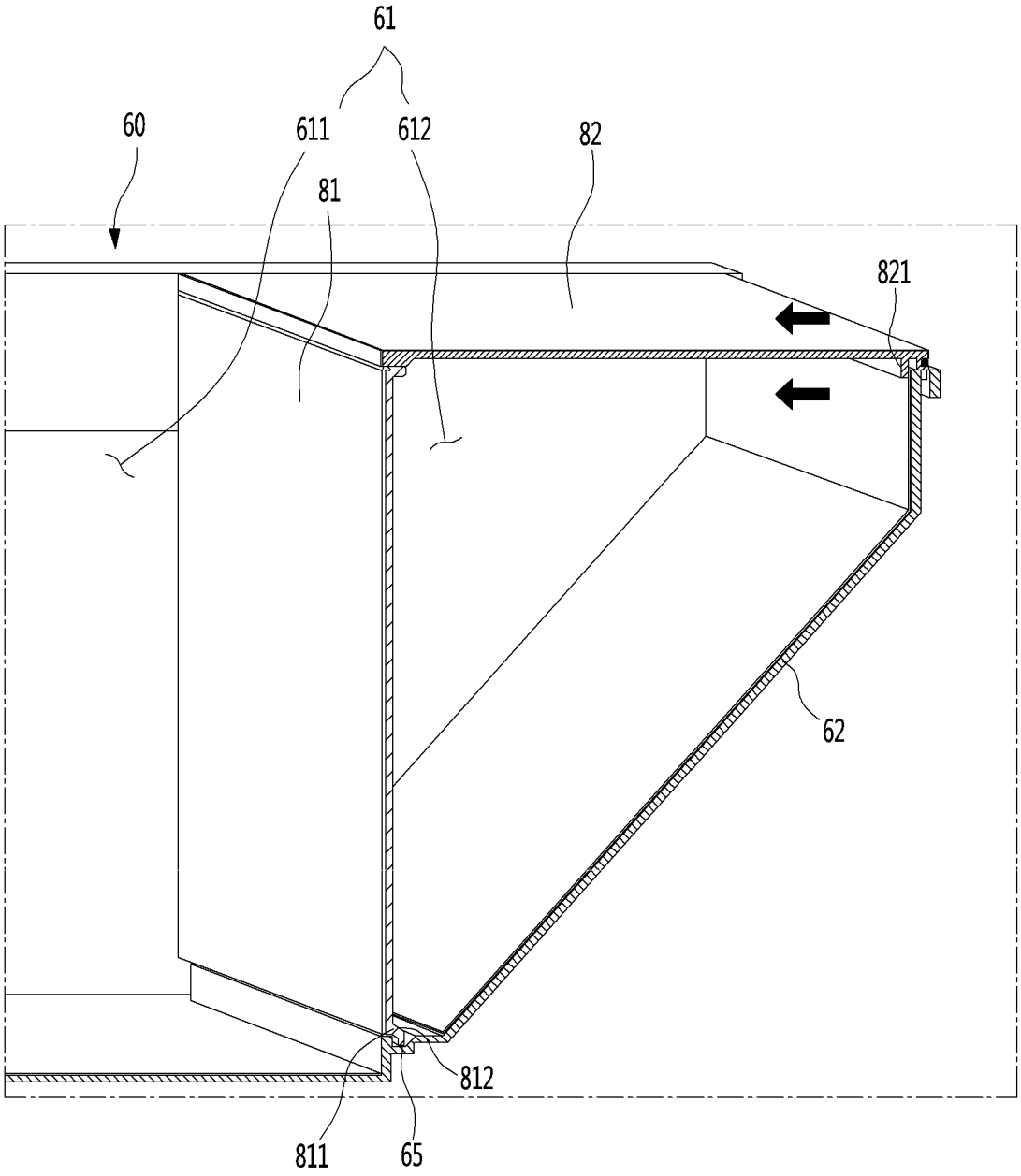
FIGS. 11 to 13 are views illustrating a process of opening the rear space of FIG. 13.
Figure 12:
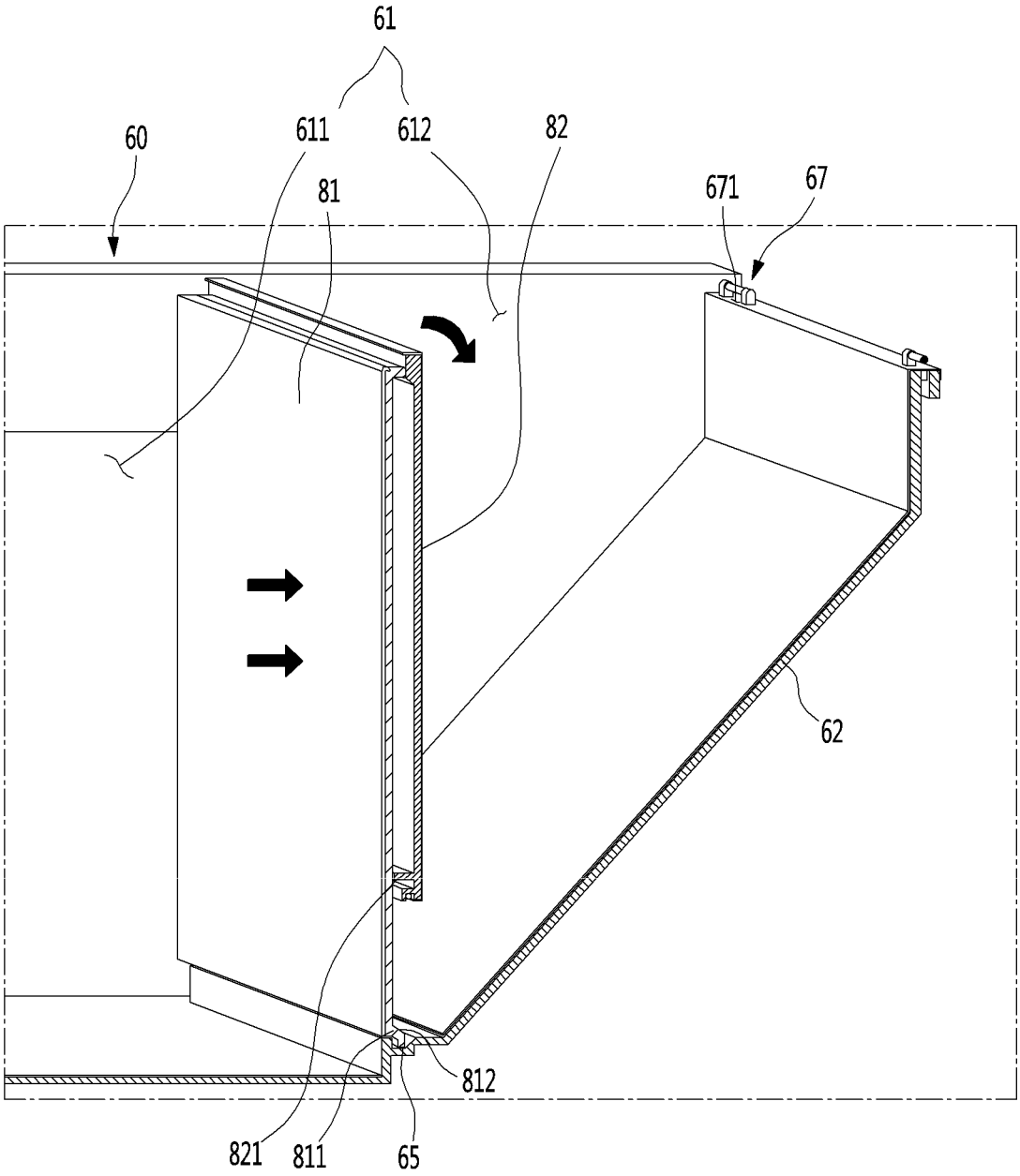
Figure 13:
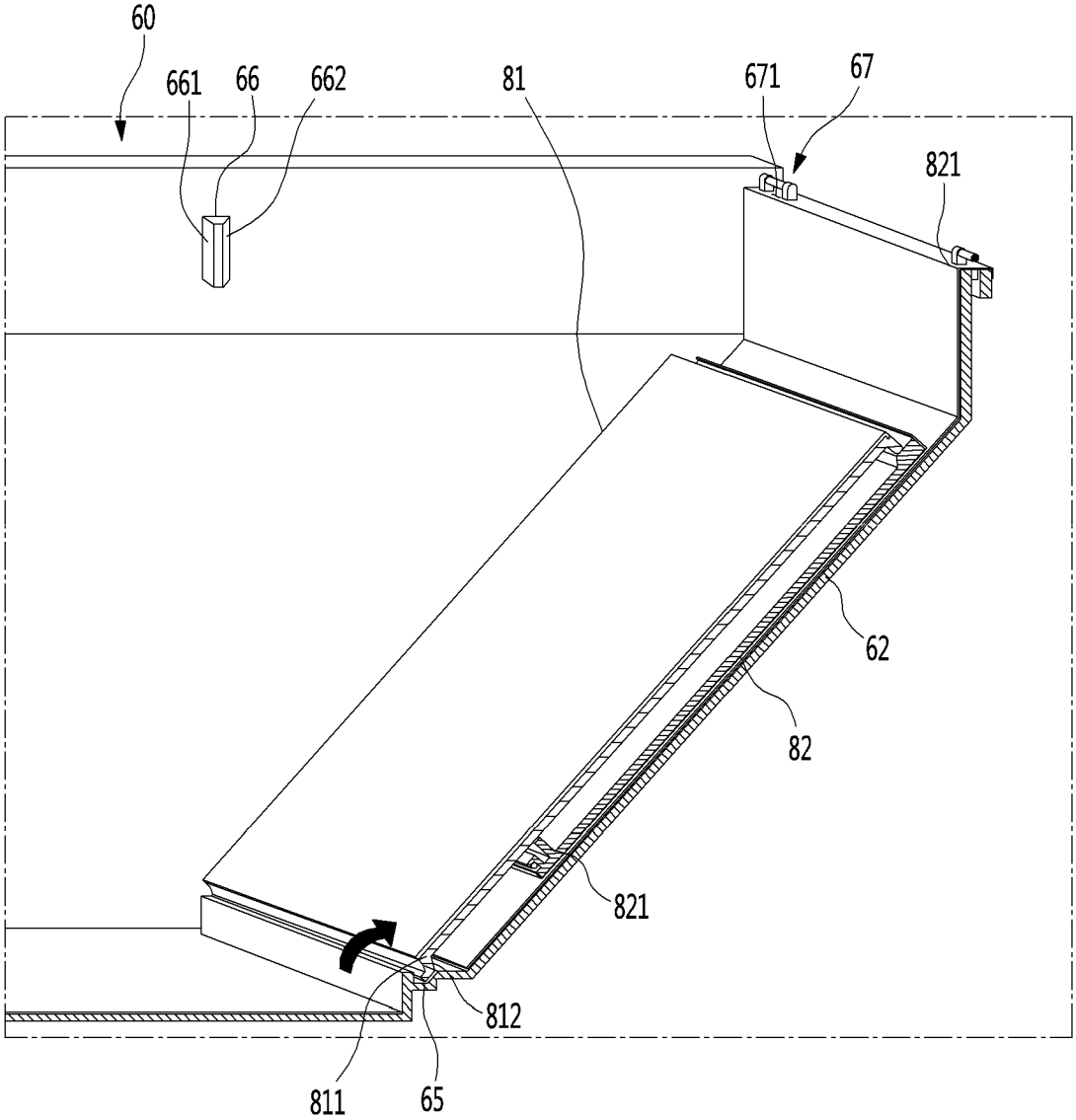

FIGS. 11 to 13 are views illustrating a process of opening the rear space of FIG. 13.

Referring to FIG. 11, in the state in which the drawer cover 80 closes the rear space 612, the fixing of the hook part 824 and the fixing protrusion 67 may be released. The release of the fixing may be performed by pressing the hook part 824 in a direction of the through-hole 671.

When the cover part 82 is pushed forward with a predetermined force in a state in which the hook part 824 and the fixing protrusion 67 are released, the partition part 81 may be elastically deformed, and thus, the rear end of the cover part 82 may be disposed inside the drawer storage space 61. Thus, the cover part 82 may rotate into the drawer storage space 61 by using the second hinge 813 as an axis.

Referring to FIG. 12, the cover part 82 may rotate toward the partition part 81, and the cover part 82 may be seated on the rear surface of the partition part 81. Here, the cover part 82 and the partition part 81 may be parallel to each other. Of course, the cover part 82 and the partition part 81 may not exactly parallel to each other.

The cover part 82 may press the rotation restriction protrusion 66 during the rotation of the cover part 82 toward the partition part 81. Thus, the rotation restriction protrusion 66 may move outward, and the partition part 81 may be rotatable about the lower end of the partition part 81.

Finally, referring to FIG. 13, when the partition part 81 is pushed backward, the partition part 81 may rotate by using the lower end of the partition part 81 as an axis. Thus, the partition part 81 may be seated on the drawer inclined surface 62 to open the rear space 612. Of course, actually, it is the cover part 82 that is seated on the inclined surface 62, and the inclined surface 62, the cover part 82, and the partition part 81 may be seated sequentially.

Also, the rotation restriction protrusion 66 may return to its original position by a spring.

In addition to the foregoing embodiment, a refrigerator according to various embodiments may be exemplified.

Hereinafter, a structure of a drawer of a refrigerator according to another embodiment will be described. Another embodiment will be described, and the same constituent as that of the foregoing embodiments will be denoted by the same reference numeral, and its detailed description will be omitted.

Figure 14:
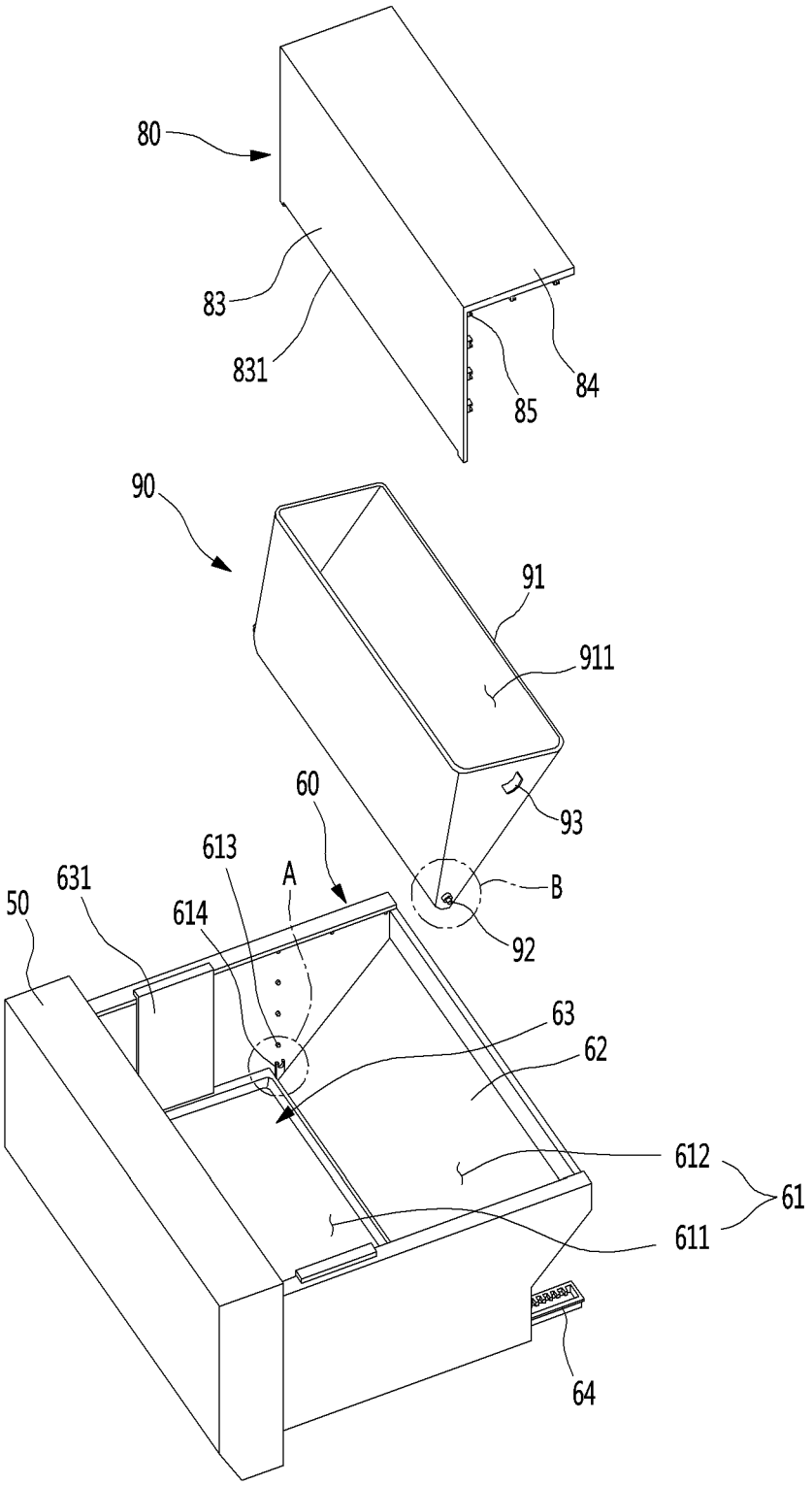
FIG. 14 is an exploded perspective view of a drawer cover and a tilting basket in a drawer door according to another embodiment.

FIG. 14 is an exploded perspective view of a drawer cover and a tilting basket in a drawer door according to another embodiment.

In another embodiment, the inside of the drawer part 60 is divided into a front space 611 and a rear space 612. Also, the rear space 612 is defined behind the front space 611, and the rear space 612 may include a tilting basket (see reference numeral 90 of FIG. 14) and a drawer cover 80.

The drawer cover 80 may partition the inside of the drawer part 60 into the front space 611 and the rear space 612 and cover the tilting basket 90 provided in the rear space 612.

The tilting basket 90 may be rotatably provided in the rear space 612. Also, the drawer cover 80 may partition the front space 611 and the rear space 612.

In detail, the drawer cover 80 may cover a front surface and a top surface of the rear space 612, and thus, the tilting basket 90 provided in the rear space 612 may be covered by the drawer cover 80.

The rear space 612 of the inside of the drawer part 60 may be covered by the mounting of the drawer cover 80. As a result, only the front space 611 may be seen as the drawer storage space 61 of the drawer part 60. Particularly, only the front space 611 partitioned by the drawer cover 80 when the drawer door 40 is withdrawn may be exposed to the outside, and the exposed front space 611, i.e., the entire front space 611 that is seen as the drawer storage space 61 may be seen as being elevated to more improve the outer appearance.

The drawer cover 80 may be detached from the rear space 612. When the drawer cover 80 is separated from the drawer part 60, the rear space 612 may be opened. If necessary, the rear space 612 and the tilting basket 90 provided in the rear space 612 may be utilized as an additional storage space in the drawer part 60.

Figure 15:
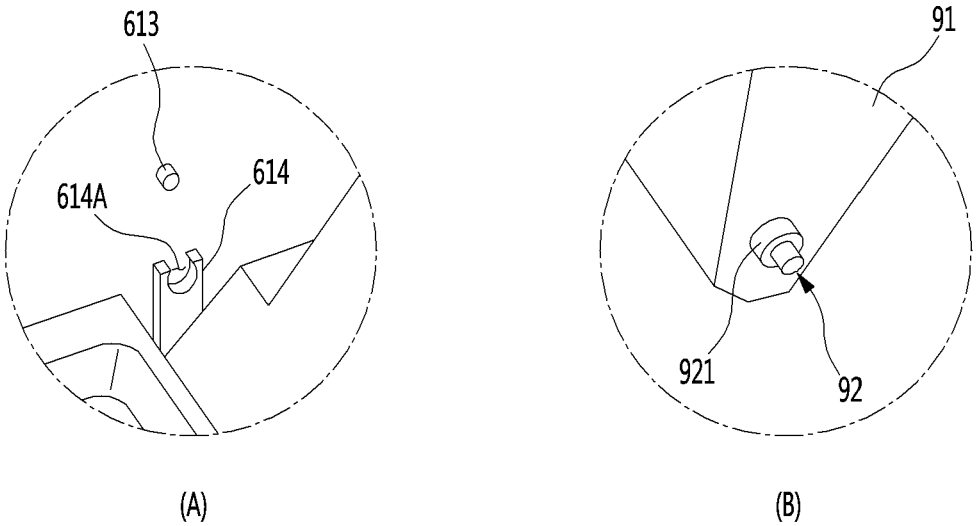
FIG. 15 is a partial perspective view illustrating a connection structure of the tilting basket.

FIG. 15 is an enlarged view illustrating portions A and B of FIG. 14.

Referring to FIGS. 14 and 15, the overall shape of the tilting basket 90 may be determined according to the shape of the rear space 612. Thus, the tilting basket 90 may have an opened top surface and a circumferential surface contacting the rear space 612 so as to have a shape corresponding to the rear space 612 on the whole.

Particularly, the front surface of the tilting basket 90 may be provided so that the front surface thereof is perpendicular to the bottom surface of the drawer storage space 61, and the rear surface thereof has an inclination corresponding to the inclined surface 62. Thus, the tilting basket 90 may have a width that gradually decreases in the front and rear direction.

The tilting basket 90 may define an overall outer appearance by a basket body 91 defining a basket space 911 having an opened upper side, and the basket body 91 may be accommodated in the rear space 612 and simultaneously may covered by the drawer cover 80.

Also, the inclined surface 62 may be disposed on the rear surface of the rear space 612, and the rear surface of the basket body 91 may have an inclination corresponding to the inclined surface 62. Thus, the inclined rear surface of the basket body 91 may be maintained in contact with the rear surface of the rear space 612.

The tilting basket 90 may be rotatably provided in the rear space 612. Thus, the tilting basket 90 may further include a rotation protrusion 92 protruding outward from each of both sides of the basket body 91.

The rotation protrusion 92 may have a cylindrical shape, and the tilting basket 90 may be coupled to the basket fixing part 614 to be described later to rotate about the rotation protrusion 92. However, the shape of the rotation protrusion 92 is not limited thereto and may be a polygonal shape. Also, the rotation protrusion 92 may include a stepped portion 921 that is stepped so that the diameter of the rotation protrusion 92 increases.

A basket fixing part 614 coupled to the tilting basket 90 may be disposed on each of both side surfaces of the rear space 612. The basket fixing part 614 may rotatably support the tilting basket 90 and simultaneously guide the tilting basket 90 so that the tilting basket 90 stably rotates without detaching the tilting basket 90.

Also, a rotation protrusion accommodation part 614A in which the rotation protrusion 92 is accommodated may be provided in the basket fixing part 614. The rotation protrusion accommodation part 614A may be recessed in a circular shape. Also, the rotation protrusion accommodation part 614A may be opened upward from the recessed surface so that the rotation protrusion 92 is accommodated. Thus, the rotation protrusion 92 may be accommodated in the rotation protrusion accommodation part 614A to rotate.

The tilting basket 90 may further include a stopper 93 protruding outward from both sides of the basket body 91.

In detail, the shape of the stopper 93 may be curved so as to be rounded, and the inner surface of the stopper 93 may be directed forward. Thus, the stopper 93 may be hooked with the cover fixing protrusion 613, which will be described later, during the rotation of the tilting basket 90.

Thus, the stopper 93 may limit a rotation angle of the tilting basket 90 when the tilting basket 90 rotates about the rotation protrusion 92. That is, when the tilting basket 90 excessively rotates forward due to the nature of the structure of the tilting basket 90, the food stored in the tilting basket 90 may be poured or suddenly rotate at a high speed. However, when the tilting basket 90 rotates by a set angle by the stopper 93, the tilting basket 90 is stopped without rotating any more.

However, the protruding length and shape of the stopper 93 may vary depending on the shape of the cover fixing protrusion 613 protruding from both sides of the inner side of the drawer part 60.

The rotation protrusion 92 and the rotation protrusion accommodation part 614A may be provided with an elastic member such as a spring. Thus, when the tilting basket 90 rotates after the tilting basket 90 rotates by a predetermined angle, the tilting basket 90 may return to its original position.

Figure 16:
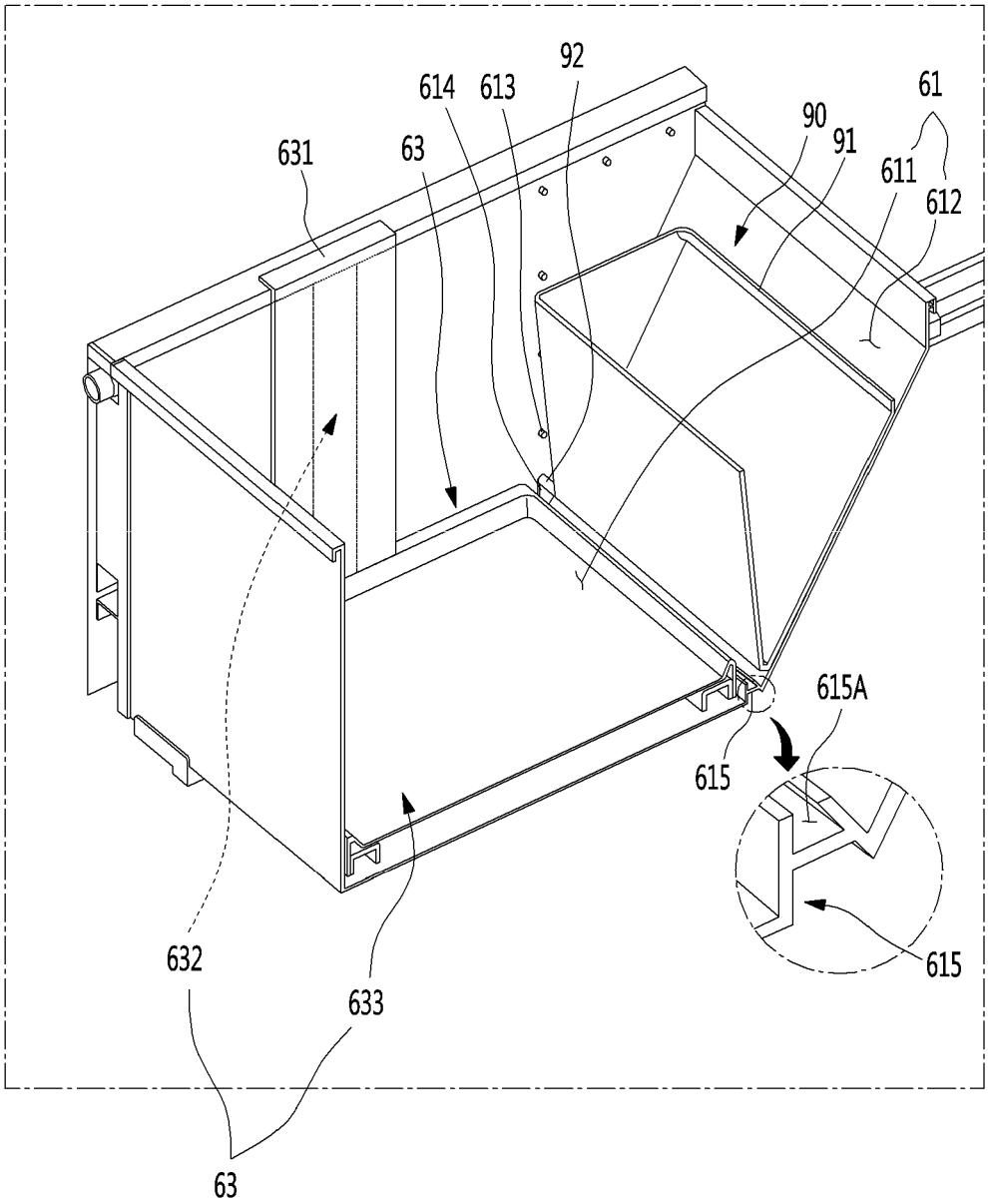
FIG. 16 is a cross-sectional view illustrating a structure in which a partition part of the drawer cover is fixed.

FIG. 16 is a cross-sectional view illustrating a structure in which a partition part of the drawer cover is fixed. FIG. 17 is a rear perspective view of the drawer cover.

As illustrated in the drawings, the drawer cover 80 may include a partition part 85 for partitioning the front space 611 and the rear space 612 and a cover part 84 for covering the upper surface of the rear space 612.

The overall shape of the partition part 85 may be, for example, a rectangular shape. The partition part 85 may be vertically disposed in the front space 611 and the rear space 612 in the drawer storage space 61.

Also, a recess part 851 may be defined in the lower end of the partition part 85 to be recessed upward. The recess part 851 may be defined in at least a portion of the lower end of the partition part 85. Also, a partition part fixing part 615 may be disposed on a lower surface of a drawer storage space 61 to accommodate a lower end of the partition part 85 and fix the drawer cover 80.

The partition part fixing part 615 may protrude upward from the bottom surface of the drawer storage space 61 to define an accommodation groove 615A in which the partition part 85 is accommodated.

The cover part 84 may extend from the top surface of the partition part 85 to the top surface of the rear side of the drawer part 60 and may be seated on the top surface of the partition part 85 and the top surface of the rear side of the drawer part 60. Thus, the partition part 85 and the cover part 84 may cover the rear space 612. Since the top surface of the rear space 612 has a rectangular shape in an embodiment, the cover part 84 may have a rectangular shape. However, the shape of the cover part 84 is not limited thereto.

The partition part 85 and the cover part 84 may be produced as independent parts and then bonded, coupled, or welded to each other. However, the present disclosure is not limited thereto, but may be produced integrally.

Also, each of the partition part 85 and the cover part 84 may be provided with a cover protrusion accommodation part 85 fixed to the cover protrusion accommodation part 85. The cover protrusion accommodation part 85 may be fixedly coupled to the cover fixing protrusion 613.

In detail, a cover fixing protrusion 613 may be disposed on each of both sides of the rear space 612 and spaced a predetermined distance from each other to protrude inward. Also, the drawer cover 80 may be provided with the cover protrusion accommodation part 85 extending toward the cover fixing protrusion 613 to accommodate the cover fixing protrusion 613.

The cover fixing protrusion 613 may be disposed at a position adjacent to the inside of the drawer cover 80 in the rear space 612. In more detail, the cover fixing protrusion 613 may be disposed along a path in which an inner surface of the drawer cover 80 contacts both side surfaces of the rear space 612 when the drawer cover 80 covers the rear space 612. Also, each of the cover fixing protrusion 613 and the cover protrusion accommodation part 85 may be provided in plurality.

Also, the cover protrusion accommodation part 85 may extend from each of both side ends of the drawer cover 80 toward the cover fixing protrusion 613. Also, the cover protrusion accommodation part 85 may be provided with an opening 851 which surrounds the cover fixing protrusion 613 and is opened at one side so as to be detachable. Thus, when the drawer cover 80 covers the rear space 612, the cover protrusion accommodation part 85 may be coupled to the cover fixing protrusion 613 and then fixed.

The cover protrusion accommodation part 85 has to be made of a material having constant elasticity so as to be fixed to the cover fixing protrusion 613. Also, the opening direction of the opening 851 has to be determined in a direction that facilitates the coupling with the cover fixing protrusion 613. For example, the opening 851 may be defined under the rear side of the cover protrusion accommodation part 85 according to the direction in which the drawer cover 80 is mounted so that the drawer cover 80 is mounted through the opening 851.

The cover fixing protrusion 613 may be a cylindrical shape. Thus, the cover protrusion accommodation part 85 may have a ring shape having one side opened to surround the periphery of the cover fixing protrusion 613. However, the shape of the cover fixing protrusion 613 is not limited thereto, and the shape of the protrusion accommodation part 85 may also be determined according to the shape of the cover fixing protrusion 613.

Figure 18:
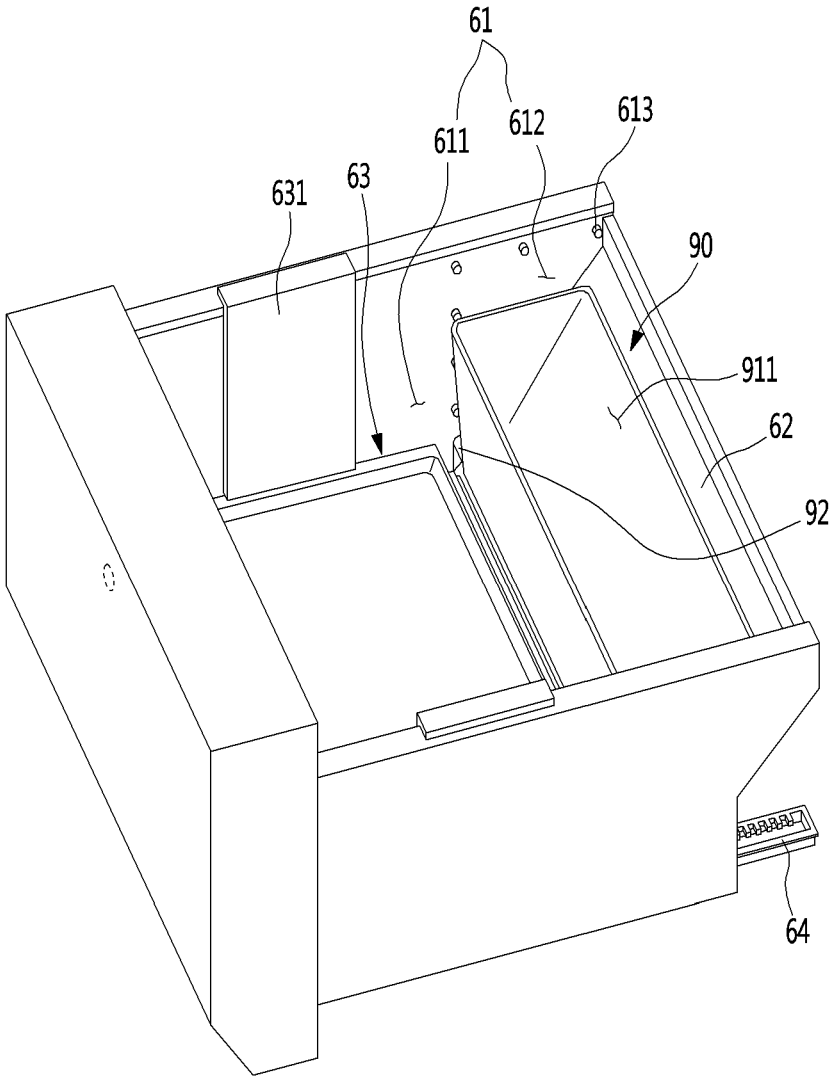
FIG. 18 is a perspective view illustrating a state in which the drawer cover is separated from the drawer door, and the tilting basket is exposed.
Figure 19:
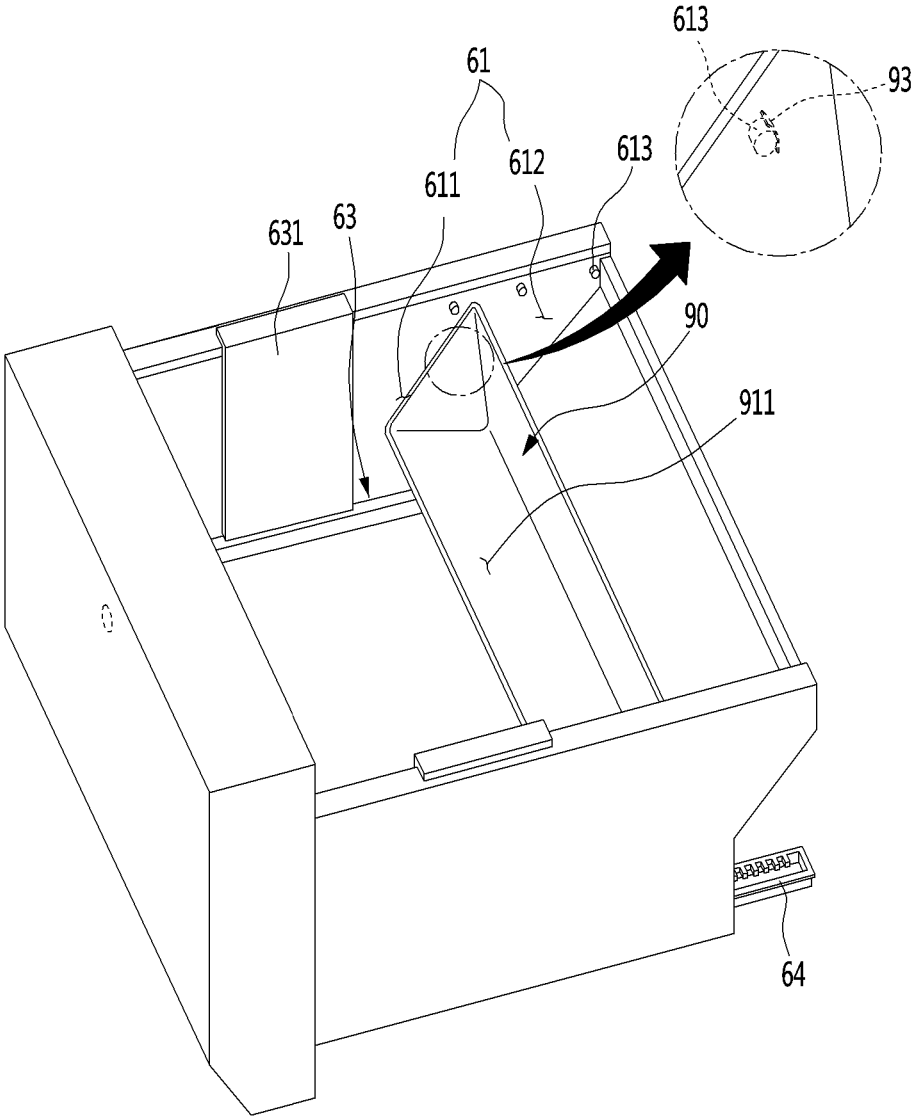
FIG. 19 is a perspective view illustrating a state in which the tilting basket is tilted in FIG. 18.

FIG. 18 is a perspective view illustrating a state in which the drawer cover is separated from the drawer door, and the tilting basket is exposed. FIG. 19 is a perspective view illustrating a state in which the tilting basket is tilted in FIG. 18.

Referring to FIGS. 18 and 19, when the drawer cover 80 is separated from the drawer part 60, the rear space 612 may be exposed. Thus, the tilting basket 90 which is covered by the drawer cover 80 may also be exposed, so that the food may be stored.

When the drawer door 40 is withdrawn, the front space 611 may be completely exposed to the outside of the cabinet storage space 11 of the cabinet 10, but the rear space 612 and the opened top surface of the tilting basket 90 provided in the rear space 612 may not be exposed to the outside of the cabinet storage space 11 of the cabinet 10.

In this case, the user may hold the front end of the tilting basket 90 to allow the tilting basket 90 to rotate. Thus, the opened top surface of the tilting basket 90 may be exposed so as to be accessible or visible outside the cabinet storage space 11 of the cabinet 10, and the user may store food in the tilting basket 90.

In detail, the tilting basket 90 may rotate forward around the rotation protrusion 92 by the user's manipulation and then be tilted. Also, in the state in which the tilting basket 90 rotates at a predetermined angle, since the opened upper side of the basket space 911 moves to the front space 611, the tilting basket 90 may easily store the food.

Also, the tilting basket 90 may rotate naturally due to inertia of the drawer door 40 being withdrawn. That is, when the drawer door 40 is withdrawn, the tilting basket 90 may rotate till contacting the stopper 93, and the opened top surface of the tilting basket 90 may be directed forward. Also, when the drawer door 40 is inserted, the tilting basket 90 may rotate in the opposite direction so that the rear surface of the tilting basket 90 contacts the inclined surface 62. Here, the opened top surface of the tilting basket 90 may be directed upward.

Of course, if the storage container 70 is separated from the drawer part 60, the tilting basket 90 may be used more smoothly. If the elevation function of the drawer part 60 is not used, the seating member 633 may be separated from the elevation device to utilize the space of the drawer part 60 as much as necessary.

In addition to the foregoing embodiment, a refrigerator according to various embodiments may be exemplified.

Hereinafter, a structure of a drawer of a refrigerator according to another embodiment will be described. Another embodiment will be described with reference to the accompanying drawings, and the same constituent as that of the foregoing embodiments will be denoted by the same reference numeral, and its detailed description will be omitted.

Figure 20:
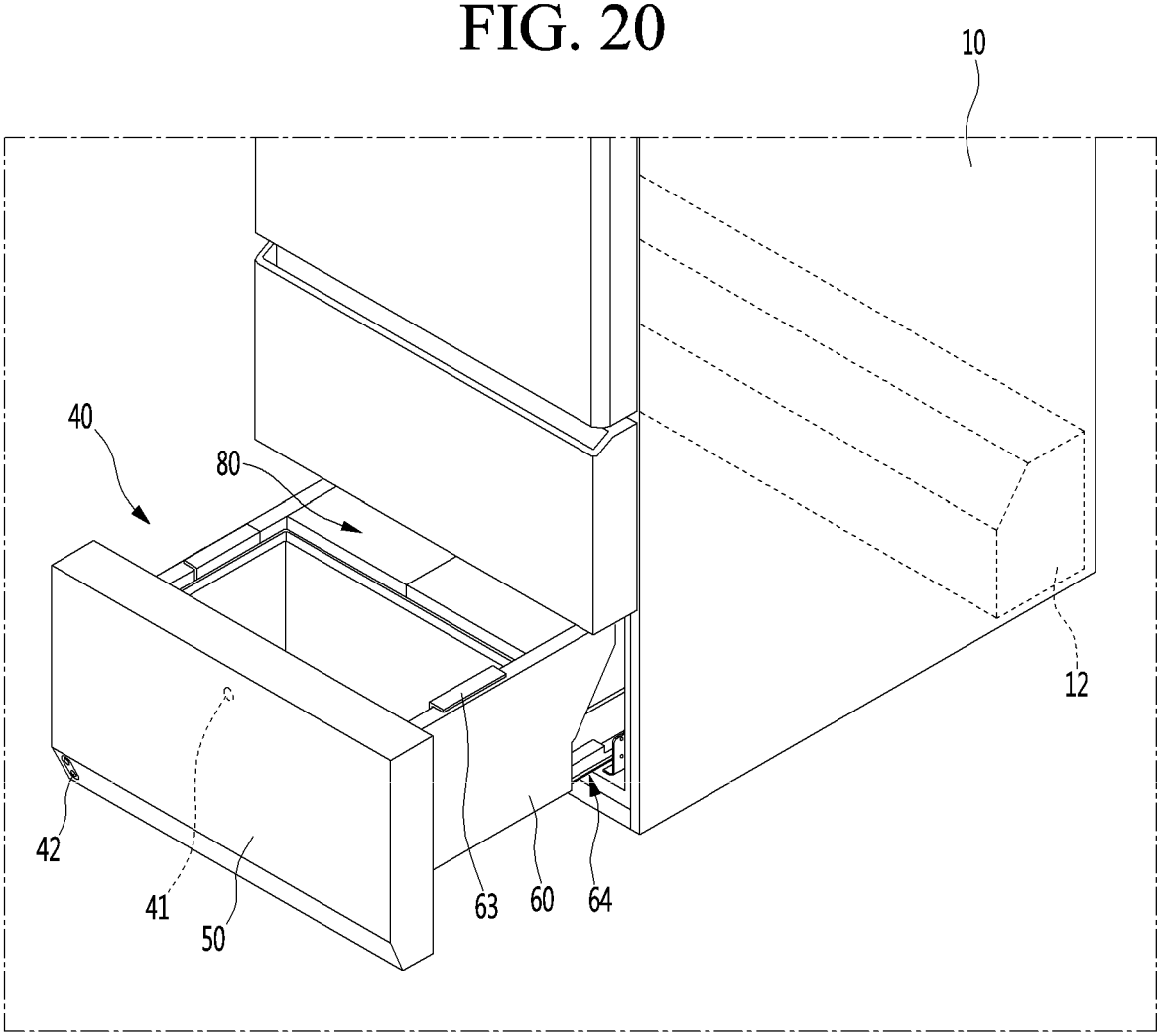
FIG. 20 is a perspective view illustrating a state in which a drawer door is withdrawn according to another embodiment.
Figure 21:
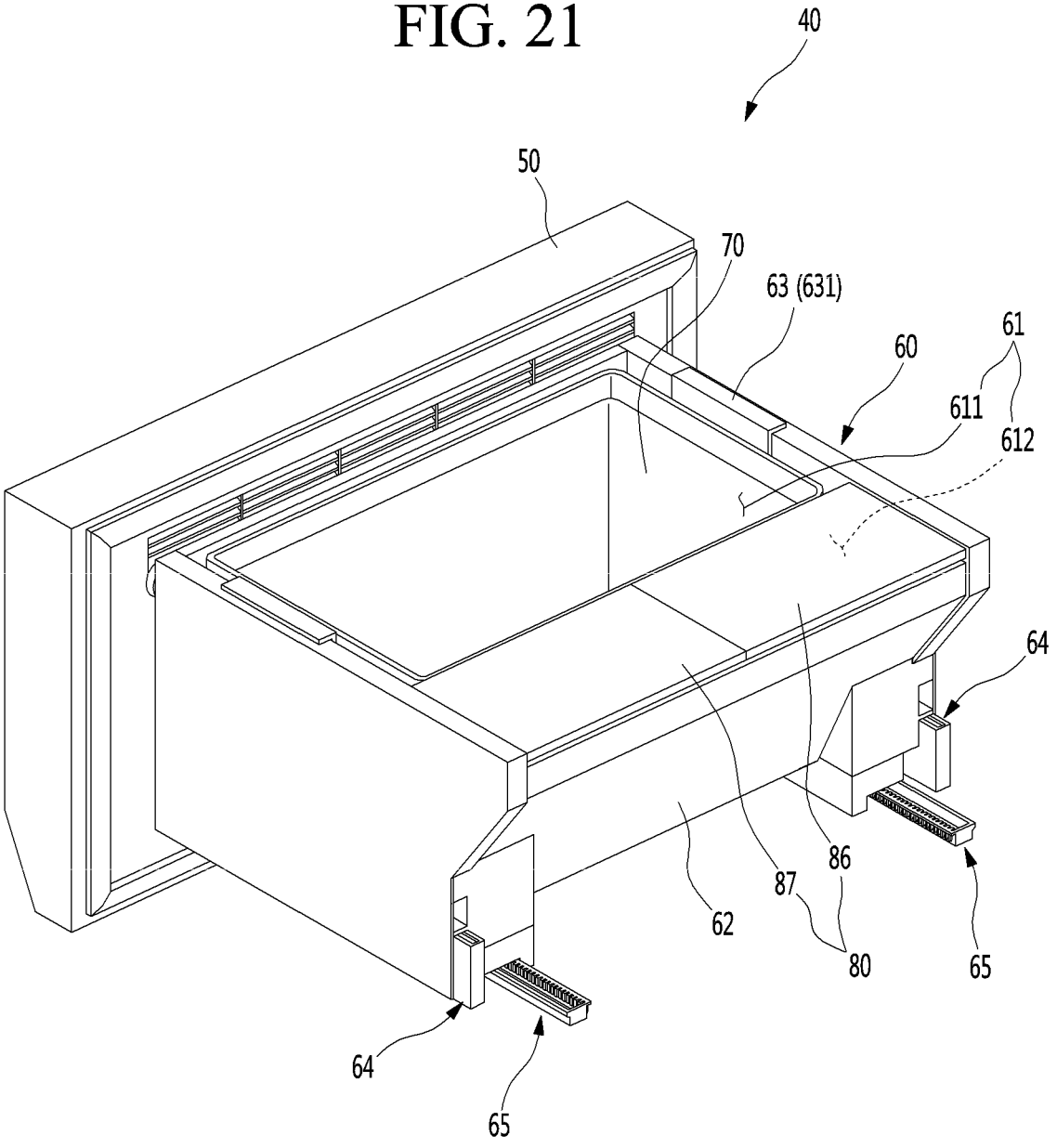
FIG. 21 is a perspective view of the drawer door.
Figure 22:
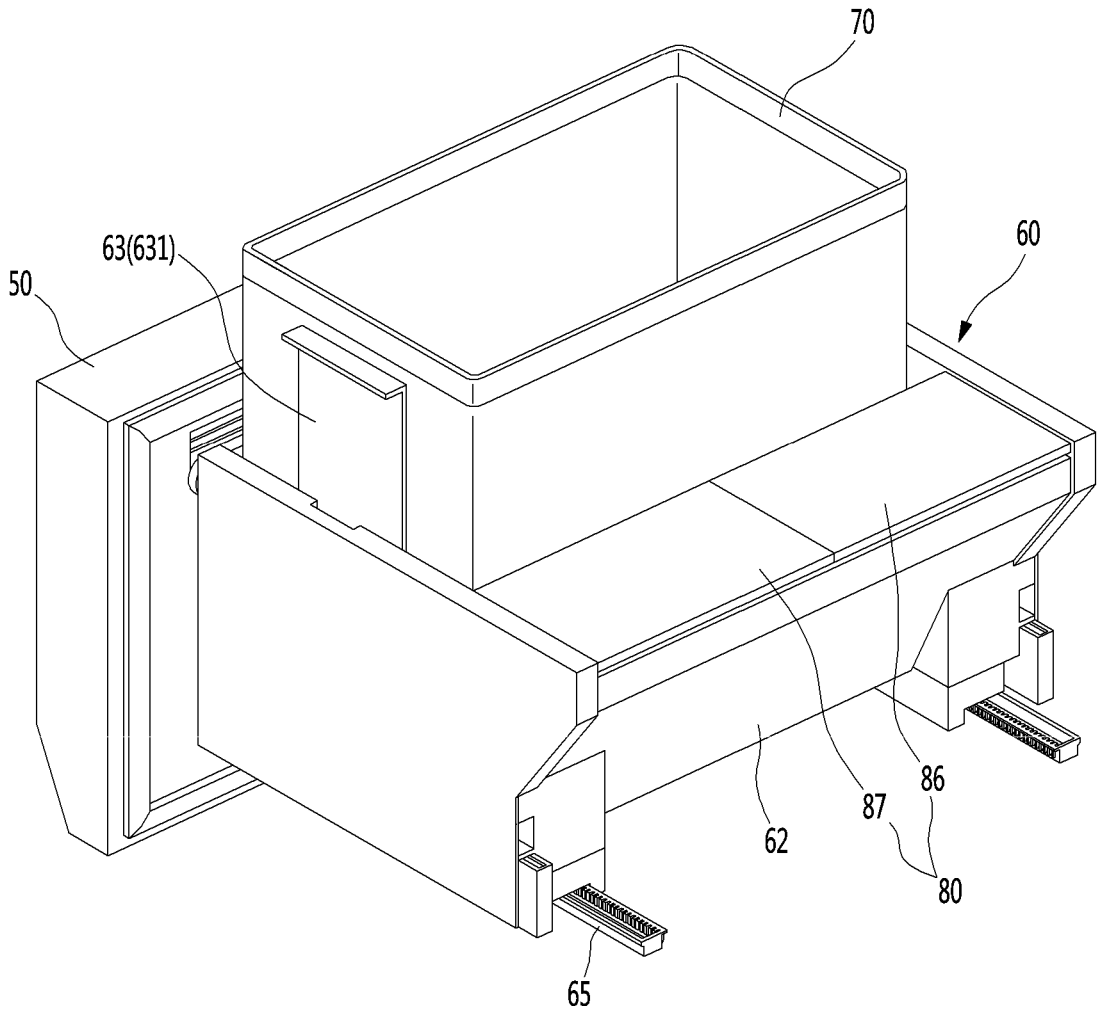
FIG. 22 is a perspective view illustrating a state in which a storage container ascends in the drawer door of FIG. 21.

FIG. 20 is a perspective view illustrating a state in which a drawer door is withdrawn according to another embodiment. Also, FIG. 21 is a perspective view of the drawer door of FIG. 21. Also, FIG. 22 is a perspective view illustrating a state in which a storage container ascends in the drawer door of FIG. 21.

As illustrated in the drawings, a drawer door 40 according to another embodiment may include a front panel door part 50 and a drawer part 60. Also, the inside of the drawer part 60 may be divided into a front space 611 and a rear space 612 by a drawer cover 80. Also, the drawer cover 80 may cover front and top surfaces of the rear space 612, and thus, the rear space 612 may be covered without being exposed.

Thus, the rear space 612 may be completely covered by the drawer cover 80, and as if the rear space 612 may not exist when the drawer door 40 is withdrawn.

Particularly, since the drawer door 40 has a structure in which the front space 611 is exposed to the outside, and the rear space 612 is withdrawn to be disposed inside the cabinet storage space 11 of the cabinet 10, the drawer door 40 may have a neat appearance in the state of being withdrawn.

The drawer cover 80 may be provided in a pair on left and right sides and may partially open the rear space 612 through sliding movement thereof. Thus, after the drawer cover 80 slidably moves, a food may be stored in the rear space 612.

The drawer cover 80 may include a left cover 86 and a right cover 87, which are disposed on both sides of the drawer cover 80. The left cover 86 and the right cover 87 may have the same size and shape. Also, either the left cover 86 or the right cover 87 may slidably move to open the rear space 612.

Hereinafter, the structure in which the drawer cover 80 opens and closes the rear space 612 will be described in detail.

Figure 23:
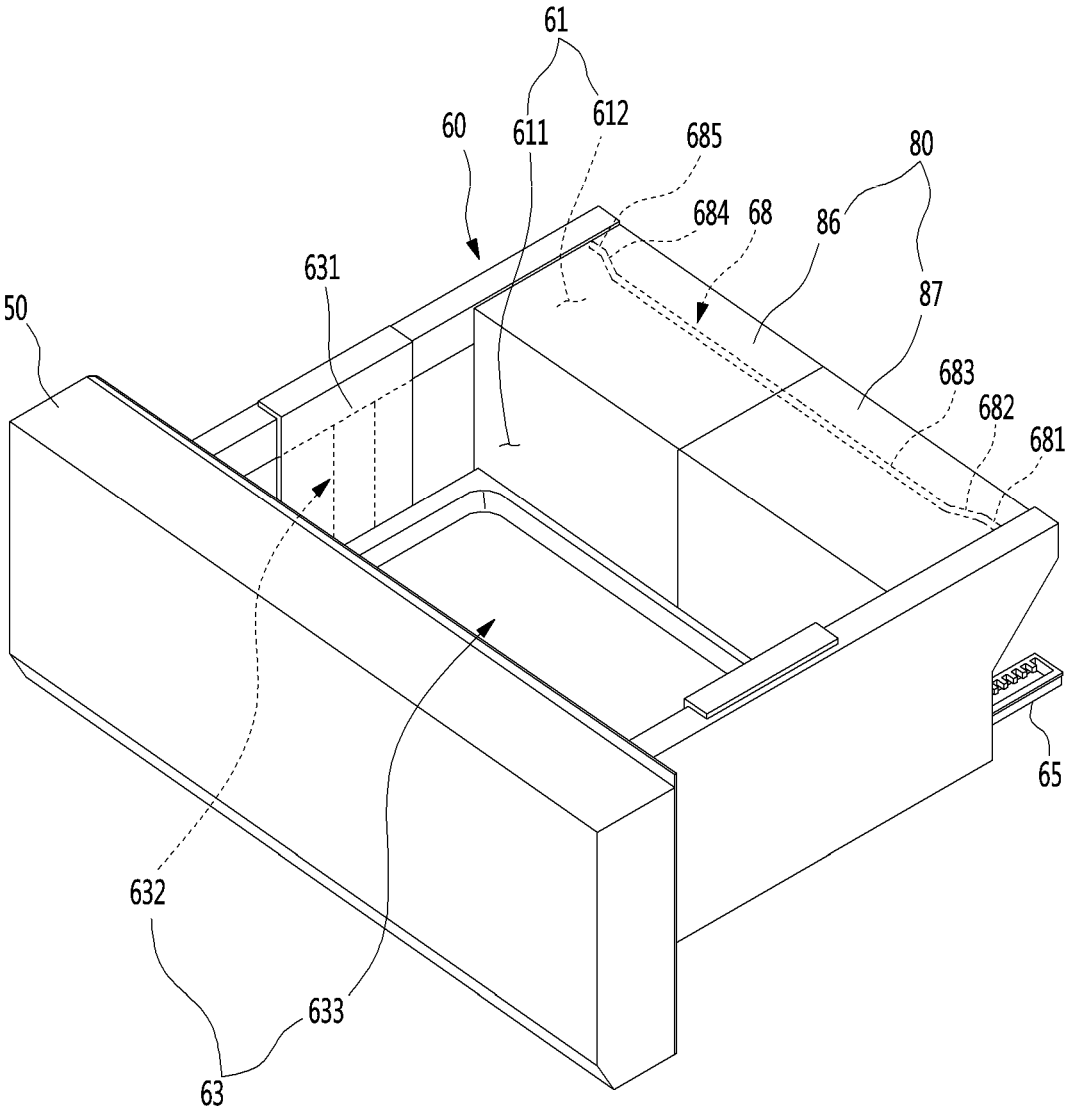
FIG. 23 is a perspective view illustrating a state in which a drawer cover provided in the drawer door covers a rear space.

FIG. 23 is a perspective view illustrating a state in which the drawer cover provided in the drawer door covers the rear space. Also, FIG. 24 is a view illustrating a state in which the right cover slidably moves to open the rear space in FIG. 23.

Figure 24:
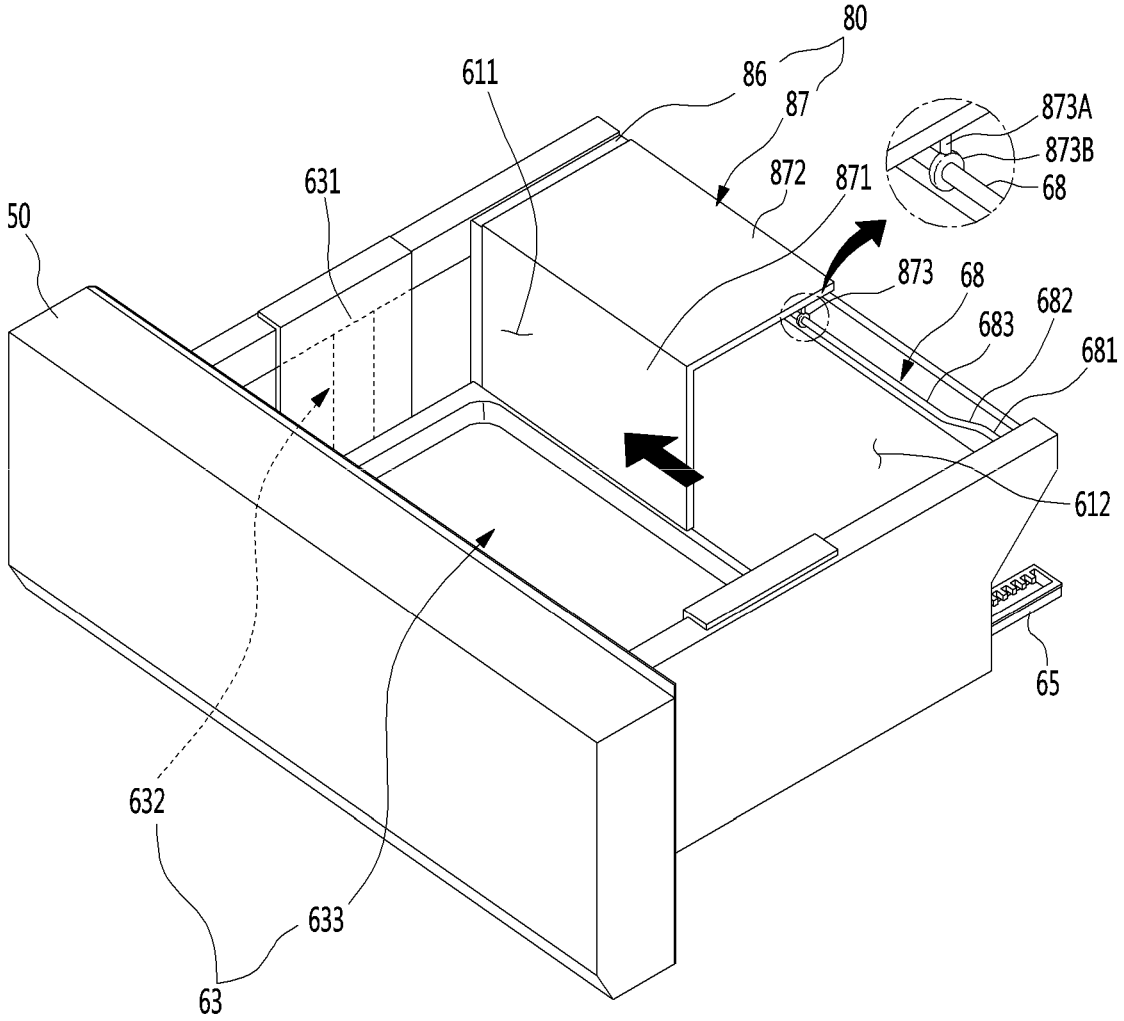
FIG. 24 is a view illustrating a state in which a right cover slidably moves to open the rear space in FIG. 23.

Referring to FIGS. 23 and 24, when the front space 611 is used as a space for elevation by using the elevation assembly within the front space 611, the rear space 612 may be completely covered by the drawer cover 80 as illustrated in FIG. 23.

The drawer cover 80 may include a left cover 86 for covering the left side of the rear space 612 and a right cover 87 for covering the right side of the rear space 612.

Each of the left cover 86 and the right cover 87 may be configured to cove a half of the rear space 612. If necessary, the left cover 86 and the right cover 87 may have different sizes. The left cover 86 and the right cover 87 may not cover the rear space 612 exactly half, and either one may more cover the rear space 612. Also, the left cover 86 and the right cover 87 may be configured to completely cover the rear space in the state in which the left cover 86 and the right cover 87 are disposed side by side even if the sizes of the left and right covers 86 and 87 are different.

The left cover 86 and the right cover 87 may include partition parts 811 and 821 for partitioning the front space 611 and the rear space 612 and cover parts 812 and 822 for covering the upper surface of the rear space 612, respectively.

In detail, each of the partition parts 811 and 821 may extend perpendicularly to an inner bottom surface of the drawer part 60 at the rear end of the front space 611. Here, lower ends of the partition parts 811 and 821 may contact the bottom of the drawer part 60, and upper ends of the partition parts 811 and 821 may extend up to an upper end of the drawer part 60. A groove into which the lower end of each of the partition parts 811 and 821 is inserted may be defined in the bottom of the drawer part 60 to guide the partition parts 811 and 821 when the left and right covers 86 and 87 slidably move.

The cover parts 812 and 822 may vertically extend backward from the upper ends of the partition part 811 and 821 and extend to the rear end of the drawer part 60. Thus, the cover parts 812 and 822 may completely cover the top surface of the rear space 612.

The upper ends of the partition parts 811 and 821 and the front ends of the cover parts 812 and 822 may be connected to each other to form a single body, but is not limited thereto. That is, the partition parts 811 and 821 and the cover parts 812 and 822 may be separated from each other and may be configured to move independently with respect to each other. Of course, the partition parts 811 and 821 and the cover parts 812 and 822 may be configured to be coupled to each other.

The partition part of the left cover 86 may be called a left partition part 811, the partition part of the right cover 87 may be called a right partition part 871, the cover part of the left cover 86 may be called a left cover part 812, and the cover part of the right cover 87 may be called a right cover part 872.

Contact ends of the left cover 86 and the right cover 87 may be formed to cooperate with each other. Thus, when the rear space 612 is covered, the ends of the left cover 86 and the right cover 87 facing each other may be closely attached to contact each other. Also, the left cover 86 and the right cover 87 may be completely in close contact with each other to improve a sense of unity, and the rear space 612 may not be exposed between the left cover 86 and the right cover 87 to more improve the appearance.

Also, each of the contact ends of the left cover 86 and the right cover 87 may be rounded or inclined. In this case, when the left cover 86 and the right cover 87 slidably moves in the left and right direction, the left cover 86 and the right cover 87 may easily move in a lateral direction so that the left cover 86 and the right cover 87 overlap each other in a state in which the left cover 86 and the right cover 87 contact each other.

The rear ends of the cover parts 821 and 822 may be seated on the upper end of the rear surface of the drawer part 60, and the lower ends of the partition parts 811 and 821 may be seated on the bottom surface of the drawer part 60. Thus, the drawer cover 80 may be supported by the bottom surface of the drawer part 60 and the upper end of the rear surface of the drawer part 60 to maintain the stable mounting state.

A guide rod 68 may be provided inside the rear space 612, and the drawer cover 80 may be mounted to be slidable in the left and right direction by the guide rod 68. In detail, the guide rod 68 may lengthily extend horizontally to be connected to both sides of the rear space 612. Also, the guide rod 68 may be provided on the rear side of the rear space 612 and may be connected to the left cover part 812 and the right cover part 872.

The guide rod 68 may extend from one side to the other side of the left and right sides of the drawer part 60 and may have a round bar shape for smooth movement of the left cover 86 and the right cover 87. The guide rod 68 may have various shapes capable of slidably supporting the drawer cover 80.

Also, the guide rod 68 may be disposed at a position that is close to the rear end and the upper end of the drawer part 60 to minimize an interference by the guide rod 68 when the food is accommodated in the rear space 612.

The left cover part 812 and the right cover part 872 may be provided with guide members 813 and 823 connected to the guide rod 68. The guide member provided on the left cover part 812 may called a left guide member 813, and the guide member provided on the right cover part 872 may called a right guide member 873.

The left guide member 813 and the right guide member 873 may have the same structure and shape except for only the mounting position thereof. Also, the left guide member 813 and the right guide member 873 may be provided on the left cover part 812 and the right cover part 812, respectively.

The guide members 813 and 823 may be provided on the bottom surfaces of the cover parts 812 and 822 and may be fixedly mounted at positions corresponding to the guide rods 68. Also, the guide member 873 may be connected to the guide rod 68 move along the guide rod 68. Thus, the left cover part 812 or the right cover part 872 may be configured to slidably move along the guide members 813 and 823 in the left and right direction.

In detail, the guide members 813 and 823 may be provided with extension parts 813A and 823A extending from the bottom surface of the cover parts 812 and 822 toward the guide rod 68 and fixing parts 813B and 823B through which the guide rod 68 passes.

Each of the fixing parts 813B and 823B may have a shape corresponding that of the guide rod 68. For example, when the guide rod 68 has a round rod shape, each of the fixing parts 813B and 823B may have a ring shape so that the guide rod 68 passes through the fixing parts 813B and 823B. Each of the fixing parts 813B and 823B may have an annular shape through which the guide rod 68 passes, in addition to the ring shape.

Also, an inner circumference of each of the fixing parts 813B and 823B may be larger than an outer circumference of the guide rod 68 so that the sliding movement of the guide member 813 823 is facilitated. Also, inner surfaces of the fixing parts 813B and 823B may be further provided with rolling members for minimizing friction with the guide rods 68 so that the guide members 813 and 823 are slid more smoothly.

The extension parts 813A and 823A connect the bottom surfaces of the cover parts 812 and 822 to the fixing parts 813B and 823B, and each of the extension parts 813A and 823A may extend by a predetermined length. The fixing parts 813B and 823B may move along the guide rod 68 while maintaining the fixed parts 813B and 823B to be separated a predetermined distance from the cover parts 812 and 822 by the extension parts 813A and 823A.

The guide rod 68 may include a first extension part 681 extending vertically from the right surface of the rear space 612, a first bent part 682 bent diagonally from the first extension part 681, a second extension part 683 bent from the first bent part 682 to extend in parallel to the first extension part 681, a second bent part 684 bent diagonally from the second extension part 683, and a third extension part 685 bent from the second bent part 684 to extend in parallel to the first extension part 681 in the same extension line and connected to the left surface of the rear space 612.

The first bent part 682 and the second bent part 684 may be disposed at positions adjacent to both left and right sides of the rear space 612, respectively. Thus, the first extension part 681 and the third extension part 685 have to be shorter than a half length of the second extension part 683.

For example, the first bent part 682 may be bent diagonally forward and upward in the first extension part 681. Also, the second bent part 684 may be bent symmetrically with respect to the first bent part 682.

Also, when the left cover 86 and the right cover 87 are arranged side by side, and the drawer cover 80 covers the rear space, the right guide member 873 and the left guide member 813 may be disposed on the first extension part 681 and the third extension part 685, respectively. That is, the right guide member 873 and the left guide member 813 may be connected to the first extension part 681 adjacent to the first bent part 682 and the third extension part 683 adjacent to the second bent part 684, respectively. Also, the opposite ends of the left cover 86 and the right cover 87 may contact each other.

In this state, when the right cover 87 is slid to the left, the right cover 87 may move along the first bent part 682 by the right guide 873. Thus, the right cover 87 may move forward and upward along the first bent part 682.

Thus, the right cover 87 moving to the left side along the first bent part 682 may move in the forward and upward directions of the left cover while the right guide member 873 passes through the first bent part 682 and may overlap the left cover 86 over the end of the left cover 86. Also, when the right cover 87 is continuously slid to the left side, the right guide member 873 may be slid along the second extension part 683 over the first bent part 682 and may be slid to the left side without being hooked with the stopper 93.

That is, when the right cover 87 further moves to the left side, the right cover 87 may be slid in the state of being seated on the left cover 86, and the right guide member 873 may be slid till contacting the right end of the left cover 86.

In a state in which the right cover 87 is completely slid to the left 24 side, the right cover 87 may overlap the front and the upper sides of the left cover 86 to open a half of the rear space 612 like the state of FIG. 24.

In this state, the user may access the rear space 612, and the food may be stored in the rear space 612. Also, after the food is accommodated in the rear space, the right cover 87 may be slid to the left side to close the rear space 612. A process of closing the right cover 87 may be performed in the reverse order of the above-described process.

The left cover 86 may be guided obliquely along the second bent part 684 and be slide to the right side without being hooked with the left cover 86 when being slid to the right side. Also, the left guide member 813 may be slid until the left guide member 813 is seated on the right cover 87, and the left guide member 813 contacts the left end of the right cover 87.

When the rear space 612 is not used as a storage space of the drawer part 60, the left cover 86 and the right cover 87 may be maintained in the closed state, and the drawer door 40 may be inserted and withdrawn and be elevated.

As described above, the drawer cover 80 may be opened and closed while being slid to both the left and right sides, so that the rear space is easily utilized without separating and mounting the drawer cover 80.

The following effects may be expected in the refrigerator according to the proposed embodiments.

The portion of the front part of the drawer door may be elevated to reduce the draw-out distance of the drawer door for the elevation.

Thus, even if the front panel door part and the front region are provided with the relatively large weight for the elevation, the drawer may be stably supported to ensure the stability of use. In addition, since the draw-out distance of the drawer part does not need to be excessively long, the draw-out structure may be simplified to reduce the manufacturing cost and improve the productivity.

Also, when the drawer door is opened, the product stored in the front space may be elevated by the elevation assembly to improve the use convenience of the user.

Also, the drawer cover may partition and cover the rear space of the drawer part to prevent the food in the front space from being introduced into or falling into the rear space, thereby securing the use safety when the drawer door is elevated and improving the outer appearance.

Also, the partition part and the cover part may be rotatably connected to the storage space of the drawer part to open and close the rear space depending on the situation, and the storage space of the refrigerator may be efficiently used.

Also, the first bent part and the second bent part may be provided on the lower end of the partition part, and the accommodation groove in which the second bent part is accommodated may be provided in the lower end of the storage space so that the partition portion is stably fixed to the storage space.

Also, the fixing protrusion may be disposed on the upper end of the rear portion of the drawer part, and the protrusion accommodation groove may be defined in the rear end of the cover part to accommodate the fixing protrusion, so that the cover part is stably fixed to the drawer part.

Also, the electrical device for the elevation may be disposed in the front panel door part of the drawer door, and the mechanism part connected to the electrical device and elevated may be disposed in the drawer part to improve the safety.

Also, the drawer cover may be attached to and detached from the drawer part, and when the drawer part does not perform the elevating function, the drawer cover may be opened to use the entire space of the drawer part so that the storage space may be efficiently used.

Also, the tilting basket may be rotatably provided in the rear area of the drawer part so that the tilting basket is easily tilted even when the drawer door is not fully withdrawn to easily store the foods, thereby improve the space utilization and the accommodation performance.

Also, since the lower end and both the ends of the drawer cover are fixed to the accommodation groove and the fixing protrusion, the drawer cover may not be arbitrarily separated, thereby securing the stability of use.

Also, the tilting basket may be covered while the drawer cover is mounted and maintained, and simultaneously, the tilting basket may be maintained in the fixed state, so that the tilting basket is prevented from moving and occurring noise or damage when the drawer door is inserted and withdrawn.

Also, the drawer cover may be slidable on both the left and right sides, and a portion of the rear space may be opened or closed by sliding one of the drawer covers of the left or right drawer covers, thereby enabling the storage space of the refrigerator to be used efficiently.

Particularly, when one drawer cover slidably moves, the rear space may be easily opened without interference with the front space by slidably moving in the state in which the drawer cover overlaps another drawer cover, and the opening of the rear space may be maximally secured.

Also, the drawer cover may be stably slid while being maintained in the mounted state without being separated from the drawer cover. Further, since the drawer cover is prevented from being lost and separated are unnecessary, the convenience in use may be improved.

Also, the guide rod may be provided with a bent part having the inclination so that when the drawer cover on the left side or the right side slidably moves, the guide rods may overlap without being hooked with the other drawer cover to realize the smooth slidable movement.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet that defines a cabinet storage space therein;

a front panel door part configured to open and close at least a portion of the cabinet storage space by moving away from and toward the cabinet storage space, respectively, the front panel door part defining at least a portion of an outer appearance of the refrigerator;

a drawer part that is located at a rear surface of the front panel door part, that is configured to insert into the cabinet storage space based on the front panel door part moving toward the cabinet storage space, and that is configured to withdraw from the cabinet storage space based on the front panel door part moving away from the cabinet storage space, the drawer part defining a drawer storage space therein that has an open top surface;

a drawer cover that is located inside of the drawer storage space, that is configured to partition the drawer storage space into a front space and a rear space, and that is configured to cover the rear space; and at least one draw-out rail that is located at each of both sides of the drawer part, that is configured to guide insertion of the drawer part, and that is configured to guide withdrawal of the drawer part to a position in which the front space of the drawer storage space is exposed to an outside of the refrigerator, wherein the drawer cover comprises:

a partition part configured to partition the drawer storage space into the front space and the rear space;

a cover part that extends from an upper end of the partition part to a rear end of the drawer part to cover a top of the rear space of the drawer storage space;

a first hinge configured to connect a lower end of the partition part to a bottom surface of the drawer storage space, the partition part being configured to rotate about the first hinge; and a second hinge configured to connect the partition part to the cover part, the cover part being configured to rotate about the second hinge, wherein the cover part is configured to, based on rotating about the second hinge, be seated on a rear surface of the partition part, wherein the drawer part comprises a rear surface that defines a portion of the drawer storage space, the rear surface of the drawer part comprising an inclined surface that is inclined with respect to the bottom surface of the drawer storage space, and wherein the partition part is configured to, based on rotating about the first hinge, be seated on the inclined surface of the drawer part.

2. The refrigerator according to claim 1, wherein a lower end of the partition part is detachably mounted to a bottom surface of the drawer part, and wherein a rear end of the cover part is detachably mounted to an upper end of the drawer part.

3. The refrigerator according to claim 1, wherein a length of the cover part is less than a length of the partition part, and wherein the cover part is configured to, based on rotating about the second hinge, contact a rear surface of the partition part.

4. The refrigerator according to claim 1, wherein the drawer part comprises a rotation restriction protrusion that protrudes from at least one inner surface of the drawer part toward the drawer storage space and that is configured to support at least one end of the partition part.

5. The refrigerator according to claim 1, further comprising:

a motor located inside of the cabinet storage space;

a pinion located inside of the cabinet storage space and configured to be rotated by the motor; and a draw-out rack that is located inside of the cabinet storage space, that is coupled to the pinion by gears, and that is configured to insert the drawer part to the cabinet storage space and to withdraw the drawer part from the cabinet storage space, wherein the draw-out rack is configured to withdraw the drawer part from the cabinet storage space to a position in which an entire portion of the front space of the drawer storage space is exposed to the outside of the refrigerator, and in which the rear space of the drawer storage space remains inside of the cabinet storage space.

6. The refrigerator according to claim 1, wherein the at least one draw-out rail defines a maximum withdrawal distance that allows at least a portion of the drawer cover to remain in the cabinet storage space in a state in which the drawer part is withdrawn from the cabinet storage space.

7. The refrigerator according to claim 1, further comprising:

an elevation assembly located at the front space of the drawer storage space and configured to elevate one or more objects stored in the drawer part relative to the drawer part; and a driving device that is located at the rear surface of the front panel door part and that is configured to provide power to the elevation assembly to cause the elevation assembly to elevate the one or more objects stored in the drawer part relative to the drawer part, wherein the driving device is configured to pass through a front surface of the drawer part and to connect to the elevation assembly.

* * * * *